US005375416A

United States Patent [19]

Iwata et al.

[11] Patent Number: 5,375,416

[45] Date of Patent: Dec. 27, 1994

[54] AIR-FUEL RATIO SENSOR DETERIORATION-DETECTING DEVICE FOR INTERNAL COMBUSTION ENGINES

[75] Inventors: Yoichi Iwata; Toshihiko Sato; Yasunari Seki; Tsuyoshi Takizawa, all of Wako; Takayoshi Nakayama, Tochigi, all of Japan

[73] Assignee: Honda Giken Kogyo Kabushiki Kaisha, Tokyo, Japan

[21] Appl. No.: 184,048

[22] Filed: Jan. 21, 1994

[30] Foreign Application Priority Data

Jan. 21, 1993 [JP] Japan ..... 5-026285

[51] Int. Cl.[5] ..... F01N 3/22

[52] U.S. Cl. ..... 60/276; 60/277; 60/285; 123/703

[58] Field of Search ..... 60/274, 276, 277, 285; 123/672, 674, 703

[56] References Cited

U.S. PATENT DOCUMENTS

| | | | |
|---|---|---|---|
| 4,106,448 | 8/1978 | Noguchi | 60/285 |
| 5,074,113 | 12/1991 | Matsuoka | 60/285 |
| 5,090,199 | 2/1992 | Ikuta | 60/276 |
| 5,154,055 | 10/1992 | Nakane | 60/277 |
| 5,228,286 | 7/1993 | Demura | 60/285 |
| 5,247,793 | 9/1993 | Yamada | 60/277 |
| 5,279,114 | 1/1994 | Kurita | 60/276 |
| 5,280,707 | 1/1994 | Nakashima | 60/285 |
| 5,311,737 | 5/1994 | Komatsu | 60/285 |
| 5,325,664 | 7/1994 | Seki | 60/276 |

*Primary Examiner*—Ira S. Lazarus
*Assistant Examiner*—Daniel J. O'Connor
*Attorney, Agent, or Firm*—Nikaido, Marmelstein, Murray & Oram

[57] ABSTRACT

An air-fuel ratio sensor deterioration-detecting device for an internal combustion engine having a catalytic converter arranged in the exhaust system, and first and second air-fuel ratio sensors arranged upstream and downstream of the catalytic converter respectively has an ECU which calculates an air-fuel ratio correction amount, based on outputs from the first air-fuel ratio sensors, and detects deterioration of the first air-fuel ratio sensor, based on the output from the first air-fuel ratio sensor. The ECU inhibits detection of deterioration of the first air-fuel ratio sensor when the air-fuel ratio correction amount falls outside a predetermined range.

4 Claims, 20 Drawing Sheets

MULTIPLE FAULT CHECK
S301
UPSTREAM O2 SENSOR DISCONNECTED/ SHORT-CIRCUITED?
YES
NO
S302
UPSTREAM O2 SENSOR ACTIVATED?
NO
YES
S303
ANY SENSOR FAULTY (TW,TA,PBA,NE,VH)?
YES
NO
S304
OTHER SYSTEMS FAULTY?
YES
NO
S305
OTHER SYSTEMS BEING MONITORED?
YES
NO
S306
DURING O2 FEEDBACK CONTROL?
NO
YES
S307
MISFIRE IS OCCURRING?
YES
NO
S308
OK
S309
NG
RETURN

A
B
S722
FAF1=0 ?
YES
NO
S723
FAF2←0
S724
CDLY1←TDR1
S725
KO2←KO2 +(PR×KP)
S726
LIMIT-CHECK KO2
S727
CALCULATE KREF0,KREF1
S718
LIMIT-CHECK KREF
RETURN
S728
FAF2←1
S729
CDLY1←TDL1
S730
KO2←KO2 −(PL×KP)
S712
FAF2=0 ?
S713
FAF1=0 ?
S714
CDLY1←TDR1
S715
KO2←KO2+I
S716
LIMIT-CHECK KO2
S717
CALCULATE KREF2
S719
FAF1=1 ?
S720
CDLY1←TDL1
S721
KO2←KO2−I

AIR-FUEL RATIO SENSOR DETERIORATION-DETECTING DEVICE FOR INTERNAL COMBUSTION ENGINES

BACKGROUND OF THE INVENTION

1. Field of the Invention

This invention relates to an air-fuel ratio sensor deterioration-detecting device for an internal combustion engine having air-fuel ratio sensors provided in the exhaust system at respective locations upstream and downstream of a catalytic converter in the exhaust system, for detecting the air-fuel ratio of exhaust gases at respective points.

2. Prior Art

In internal combustion engines for automotive vehicles in general, the air-fuel ratio of an air-fuel mixture supplied to an internal combustion engine is controlled in response to the concentration of oxygen in exhaust gases from the engine, which is detected by an air-fuel ratio sensor (hereinafter referred to as the "O2 sensor") such that the air-fuel ratio of the mixture becomes equal to a desired value.

The O2 sensor is liable to change in characteristics (internal resistance, electromotive force, and response time), due to its deterioration caused by heat and/or the like. The use of an O2 sensor which is deteriorated in characteristics, adversely affects the accuracy of the air-fuel ratio control.

To overcome this inconvenience, various proposals have been made, which include additionally providing an O2 sensor in the exhaust system at a location downstream of a catalytic converter in the exhaust system, in order to compensate for undesirable changes in characteristics of the air-fuel ratio feedback control performed in response to an output from the O2 sensor upstream of the catalytic converter, whereby the air-fuel ratio feedback control is carried out with high accuracy. According to this proposal, in controlling the air-fuel ratio of the mixture supplied to the engine to a desired value in a feedback manner responsive to the output from the upstream O2 sensor, a control amount used in the air-fuel ratio feedback control is corrected, based on an output from the downstream O2 sensor, to thereby compensate for deviation of the controlled air-fuel ratio from the desired value, which is due to deterioration of the upstream O2 sensor. However, this proposed solution has a disadvantage that when the upstream O2 sensor has become heavily deteriorated beyond the limit of the above-mentioned compensation, it will result in degraded exhaust emission characteristics of the engine.

To overcome this disadvantage, it has been proposed, e.g. by Japanese Patent Application No. 4-225284, filed Jul. 31, 1992 and its corresponding U.S. Ser. No. 08/098,049, filed Jul. 28, 1993, to measure an inversion period of an air-fuel ratio correction coefficient (air-fuel ratio correction amount) based on an output O2 sensor upstream of a catalytic converter during air-fuel ratio control using outputs from the upstream O2 sensor and an O2 sensor downstream of the catalytic converter, and determine that the upstream O2 sensor is deteriorated, when the measured inversion period exceeds a predetermined period. Then warning the user to replace the upstream O2 sensor with a fresh O2 sensor, thereby preventing the engine from being operated with degraded exhaust emission characteristics.

Further, in the above proposed control system, similarly to the conventional air-fuel ratio control system in general, predetermined upper and lower limit values are provided for the KO2 value in order to detect failure of fuel injection valves, such as fuel leakage and clogging of the valve element or the fuel supply pipe. That is, if fuel leaks from a fuel injection valve into the intake pipe, an amount of fuel supplied into the cylinder becomes larger than a desired fuel amount. As a result, the KO2 value decreases to be held at the lower limit value. On the other hand, clogging of the fuel injection valve prevents fuel from being supplied to the cylinder, so that the KO2 value increases to be held at the upper limit value.

In the above proposed air-fuel ratio control system, in addition to failure of a fuel injection valve or valves, the KO2 value decreases to be held at the lower limit value when a large amount of evaporative fuel is purged from a canister to the intake pipe.

When the KO2 value is held at the lower limit value during detection of deterioration of the catalytic converter, the actual fuel injection amount becomes larger than the desired amount, so that the output from the downstream O2 sensor continues to assume a value indicative of a rich air-fuel ratio without inversion, resulting in a longer inversion time period of the KO2 value.

On the other hand, when the KO2 value is held at the upper limit value, the actual fuel injection amount becomes smaller than the desired amount, so that the output from the downstream O2 sensor continues to assume a value indicative of a lean air-fuel ratio without inversion, also resulting in a longer inversion time period of the KO2 value.

When the KO2 value is thus held at the upper limit value or the lower limit value, the inversion period of the KO2 value becomes longer than a normal value. As a result, there is a fear that the determination of deterioration of the upstream O2 sensor cannot b accurately performed.

SUMMARY OF THE INVENTION

It is the object of the invention to provide an air-fuel ratio sensor deterioration-detecting device for an internal combustion engine, which is capable of detecting deterioration of an upstream O2 sensor with higher accuracy.

To attain the above object, the present invention provides an air-fuel ratio sensor deterioration-detecting device for an internal combustion engine having an exhaust system, catalytic converter means arranged in the exhaust system, first and second air-fuel ratio sensor means arranged in the exhaust system upstream and downstream of the catalytic converter means, respectively, air-fuel ratio correction amount-calculating means for calculating an air-fuel ratio correction amount, based on outputs from the first and second air-fuel ratio sensor means, and air-fuel ratio control means for controlling an air-fuel ratio of a mixture supplied to the engine, based on the calculated air-fuel ratio correction amount, comprising:

deterioration-detecting means for detecting deterioration of the first air-fuel ratio sensor means, based on the output from the first air-fuel ratio sensor means; and deterioration detection-inhibiting means for inhibiting operation of the deterioration-detecting means when the air-0fuel ratio correction amounts falls outside a predetermined range.

Preferably, the air-fuel ratio sensor deterioration-detecting device includes deterioration detection-permitting means for permitting the operation of the deterioration-detecting means after a predetermined time period elapses after the air-fuel ratio correction amount returns into the predetermined range.

In a preferred embodiment of the invention, the air-fuel ratio sensor deterioration-detecting device correction amount within a first predetermined range when the air-fuel ratio correction amount falls outside the first predetermined range, and wherein the deterioration detection-inhibiting means inhibits the operation of the deterioration-detecting means when the air-fuel ratio correction amount falls outside a second predetermined range included within the first predetermined range.

Also preferably, the air-fuel ratio sensor deterioration-detecting device includes inversion period-measuring means for measuring an inversion period with which the output from the first air-fuel ratio sensor means is inverted, and wherein the deterioration-detecting means detects deterioration of the first air-fuel ratio sensor means, based on the measured inversion period.

The above and objects, features, and advantages of the invention will be more apparent from the following detailed description taken in conjunction with the accompanying drawings.

DETAILED DESCRIPTION

The invention will now be described in detail with reference to drawings showing preferred embodiments thereof.

Figure 1:
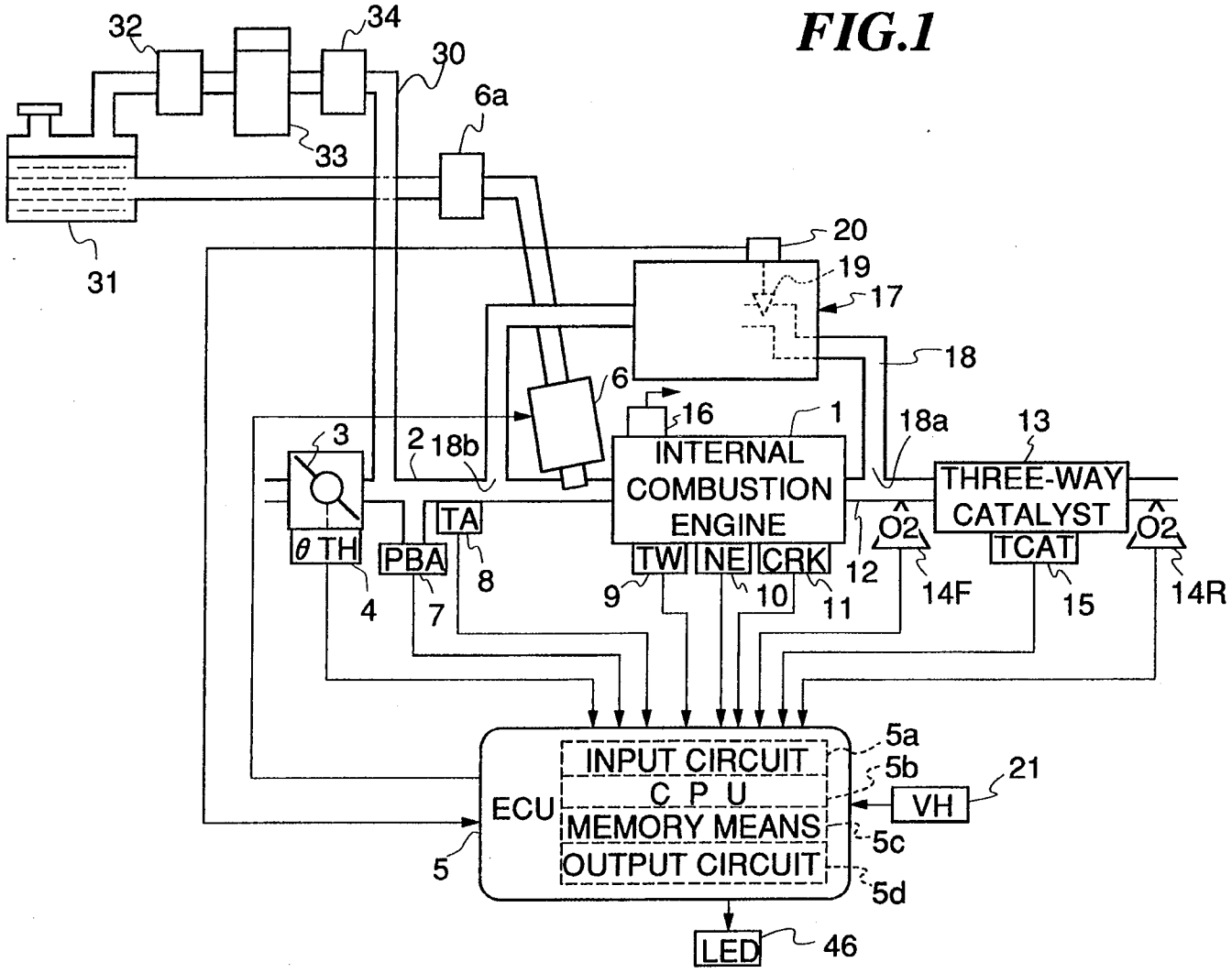
FIG. 1 is a schematic diagram showing the whole arrangement of an internal combustion engine and control systems therefor including an air-fuel ratio sensor deterioration-detecting device according to the invention.

FIG. 1 shows the whole arrangement of an internal combustion engine and control systems therefor, including an air-fuel ratio sensor deterioration-detecting device according to an embodiment of the invention. In the figure, reference numeral 1 designates an internal combustion engine having e.g. four cylinders. In an intake pipe 2 of the engine, there is arranged a throttle valve 3, to which is connected a throttle valve opening ($\theta$TH) sensor 4 for sensing the opening of the throttle valve 3 and supplying an electric signal indicative of the sensed throttle valve opening to an electronic control unit (hereinafter referred to as "the ECU") 5.

Fuel injection valves 6 are each provided for each cylinder and arranged in the intake pipe 2 between the engine 1 and the throttle valve 3 at a location slightly upstream of an intake valve, now shown. Each fuel injection valve 6 is connected via a fuel pump 6*a* to a fuel tank 31 and electrically connected to the ECU 5 to have its valve opening period controlled by a signal therefrom.

On the other hand, an intake pipe absolute pressure (PBA) sensor 7 is provided in communication with the interior of the intake pipe 2 at a location immediately downstream of the throttle valve 3 for sensing absolute pressure (PBA) within the intake pipe 2, and is electrically connected to the ECU 5 for converting the sensed absolute pressure PBA into a corresponding electric signal and supplying same to the ECU 5. Further, at a location downstream of the absolute pressure (PBA) sensor, an intake air temperature (TA) sensor 9 is inserted in to the intake pipe 2 for supplying an electric signal indicative of the sensed intake air temperature TA to the ECU 5.

An engine coolant temperature (TW) sensor 10, which may be formed of a thermistor or the like, is mounted in a coolant-filled cylinder block of the engine for supplying an electric signal indicative of the sensed engine coolant temperature TW to the ECU 5. An engine rotational speed (NE) sensor 10 and a CRK sensor 11 are arranged in facing relation to a camshaft or a crankshaft of the engine 1, neither of which is shown. The NE sensor 10 generates a pulse as a TDC signal pulse at each of predetermined crank angles whenever the crankshaft rotates through 180 degrees, while the CRK sensor 11 generates a pulse (hereinafter referred to as "the CRK signal pulse" at one of predetermined crank angles of the engine whenever the crankshaft rotates through 30 degrees, both of the pulses being supplied therefrom.

A three-way catalyst (catalytic converter as an exhaust gas-purifying device) 13 is arranged in an exhaust pipe 12 connected to the engine 1. An upstream O2 sensor 14F and a downstream O2 sensor 14R are arranged in the exhaust pipe 12 at respective locations upstream and downstream of the catalytic converter 13 for detecting the concentration of oxygen present in exhaust gases at respective points and supplying signals FVO2, RVO2 indicative of the sensed oxygen concentration to the ECU 5. The catalyst 13 is provided with a catalyst temperature (TCAT) sensor 15 for detecting the temperature of the catalyst 13 and supplying an electric signal indicative of the sensed catalyst temperature TCAT to the ECU 5. Each cylinder of the engine is provided with a spark plug 16. Also connected to the ECU 5 is a vehicle speed (VH) sensor 21 for detecting the traveling speed of a vehicle, not shown, on which the engine 1 is installed, for supplying an electric signal indicative of the sensed vehicle speed thereto.

Further, the engine 1 is provided with an exhaust gas recirculation (EGR) system 17 which comprises an exhaust gas recirculation passage 18 having one end 18*a* thereof opening into the exhaust pipe 12 at a location upstream of the catalyst 13 and the other end 18*b* opening into the intake pipe 2 at a location downstream of the throttle valve 3, and an exhaust gas recirculation control valve (hereinafter referred to as "the EGR valve") 19 arranged in the passage 18 at an intermediate location thereof for controlling the flow rate of exhaust gases recirculated.

The EGR valve 19 is comprised of an electromagnetic valve electrically connected to the ECU 5 to have valve opening thereof linearly controlled by a control signal supplied therefrom. The EGR valve 19 is provided with a lift sensor 20 for detecting the valve opening thereof and supplying an electric signal indicative of the detected valve opening to the ECU 5.

The engine 1 is further provided with an evaporative emission control system. The evaporative emission control system is comprised of an evaporative fuel passage 30 connecting between the top of the fuel tank 31, which has an airtight construction, and a portion of the intake pipe 2 immediately downstream of the throttle valve 3, and a two-way valve 32, a canister 33, and a purge control valve 34, which are all arranged across the passage 30. The purge control valve 34 is electrically connected to the ECU 5 to have valve opening thereof controlled by a signal from the ECU 5. Evaporative fuel generated from the fuel tank 31 forces a negative pressure valve, now shown, of the two-way valve 32 to open when the pressure of the evaporative fuel reaches a predetermined level and then flows into the canister 21 to be temporarily stored therein. When the purge control valve 34 is opened by the control signal from the ECU 5, evaporative fuel stored in the canister 33 is (purged) into the intake pipe 2 together with fresh air introduced through an outside air inlet port, now shown, provided in the canister 21, due to vacuum from the intake pipe 2, and then supplied to the cylinders. When the fuel tank 31 is cooled by fresh air, etc. so that the negative pressure increases within the fuel tank 31, a negative pressure valve, not shown, of the two-way valve 32 is opened to allow evaporative fuel temporarily stored in the canister 33 to return to the fuel tank 31. Thus, the emission of evaporative fuel generated from the fuel tank 31 into the atmosphere is controlled.

Further, the ECU 5 is connected to an LED (light emitting diode) 46 as warning means, referred to hereinafter, for giving a warning when the upstream O2 sensor 14F is determined to be deteriorated.

The ECU 5 comprises an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* formed of a ROM storing various operational programs which are executed by the CPU 5*b*, and various maps and tables, referred to hereinafter, and a RAM for storing results of calculations therefrom, etc., and an output circuit 5*d* which delivers driving signals to the fuel injection valves 6, the EGR valve 19, the purge control valve 39, etc.

The CPU 5*b* operates in response to the above-mentioned signals from the sensors to determine operating conditions in which the engine 1 is operating, such as an air-fuel ratio feedback control region and open-loop control regions, and calculates, based upon the determined engine operating conditions, the valve opening period or fuel injection period TOUT over which the fuel injection valves 6 are to be opened, by the use of the following equation (1), in synchronism with generation of TDC signal pulses:

$$TOUT = Ti \times KO2 \times KLS \times K_1 + K_2 \quad (1)$$

where Ti represents a basic value of the fuel injection period TOUT, which is determined according to the engine rotational speed NE and the intake pipe absolute pressure PBA.

KO2 represents an air-fuel ratio correction coefficient which is determined based on outputs from the upstream and downstream O2 sensors 14F, 14R, by a feedback control program, described hereinafter, when the engine 1 is operating in the air-fuel ratio feedback control region, while it is set to predetermined values corresponding to the respective operating regions of the engine when the engine 1 is in the open-loop control regions.

KLS represents an air-fuel ratio-leaning coefficient, which is set e.g. to a value (e.g. 0.95) smaller than 1.0 when the engine is in a leaning region falling among the open-loop regions.

K1 and K2 represent other correction coefficients and correction variables, respectively, which are set according to engine operating parameters to such values as optimize engine operating characteristics, such as fuel consumption and engine accelerability.

The CPU 5*b* supplies driving signals via the output circuit 5*d* to the fuel injection valves 6, based on the fuel injection period TOUT thus determined, to open the fuel injection valves 6.

Figure 2:
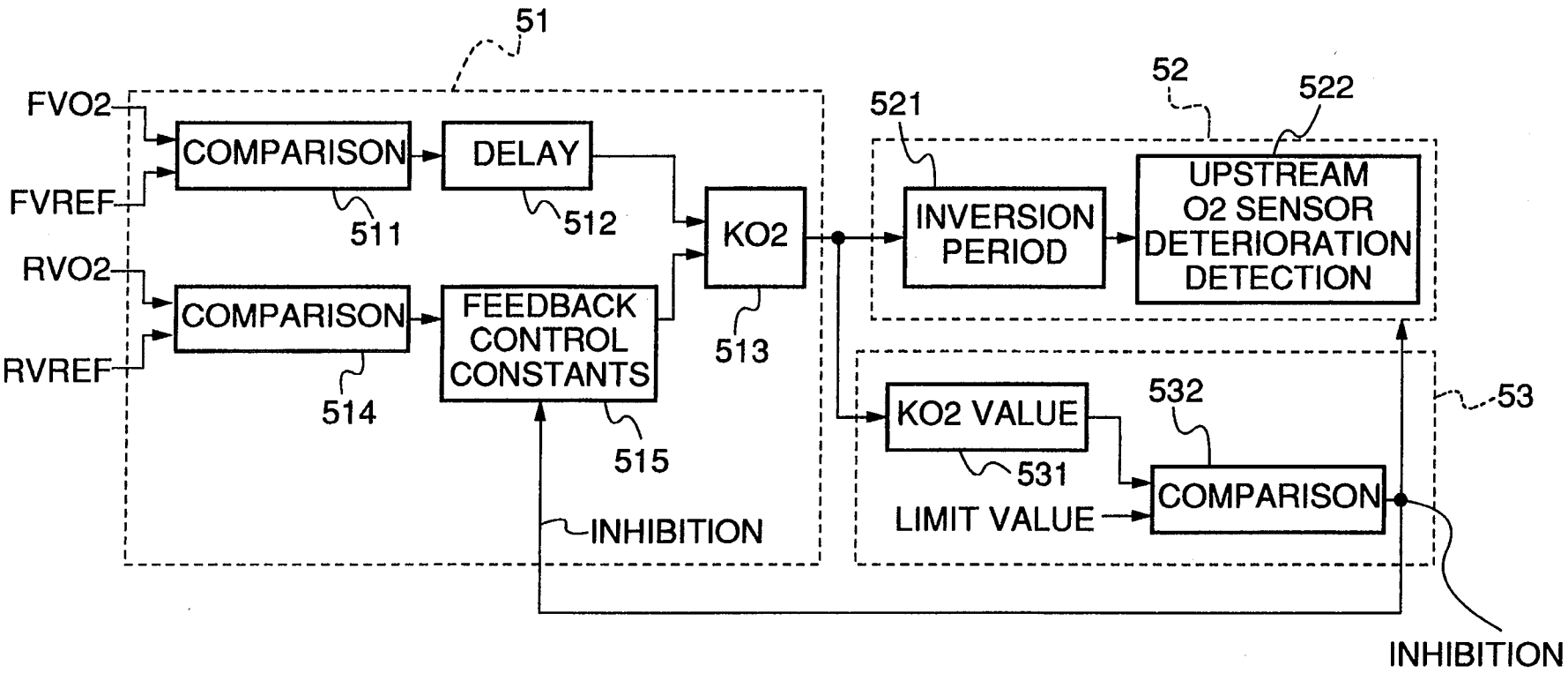
FIG. 2 is a diagram schematically showing the internal construction of a CPU which executes detection of deterioration of an upstream O2 sensor according to an embodiment of the invention.

FIG. 2 shows the internal construction of the CPU 5*b* including the oxygen sensor deterioration-detecting device according to the present embodiment.

The CPU 5*b* includes air-fuel ratio control means for carrying out the air-fuel ratio control in response to an output from the upstream O2 sensor 14F while correcting the air-fuel ratio feedback control characteristics based on an output from the O2 sensor 14R. The air-fuel ratio control means comprises air-fuel ratio correction coefficient-calculating means 51 which calculates the air-fuel ratio correction coefficient KO2 based on the output FVO2 from the upstream O2 sensor 14F, and an output RVO2 from the downstream O2 sensor 14R. The output voltage FVO2 from the upstream O2 sensor 14F is compared with a reference voltage value FVREF, hereinafter referred to, at a comparison block 511. An output from the block 511 is delayed by a delay block 512 upon inversion of the output voltage FVO2 from a rich side to a lean side or vice versa with respect to the reference voltage FVREF. An output from the block 512 is delivered to a KO2-calculation block 513 where the value of the air-fuel ratio correction coefficient KO2 is calculated based on the input from the delay block 512.

On the other hand, the output RVO2 from the downstream O2 sensor 14R is compared with a reference voltage value RVREF, hereinafter referred to, at a comparison block 514, and the result of the comparison is used by a constant-calculation block 515 to calculate feedback constants. The calculated feedback constants are applied to the KO2-calculation block 513 to correct the calculated KO2 value.

The KO2 thus calculated is delivered to deterioration-detecting means 52 and deterioration detection-inhibiting means 53. The deterioration-detecting means 52 performs detection of deterioration of the upstream O2 sensor 14F at a deterioration-detection block 522, while the deterioration detection-inhibiting means 53 compares the KO2 value with predetermined upper and lower limit values at a comparison block 532, and when the former falls outside a range defined by the upper and lower limit values, an inhibition command is delivered to the deterioration-detection block 522 as well as to the constant-calculation block 515 to inhibit operations of these blocks.

Figure 3:
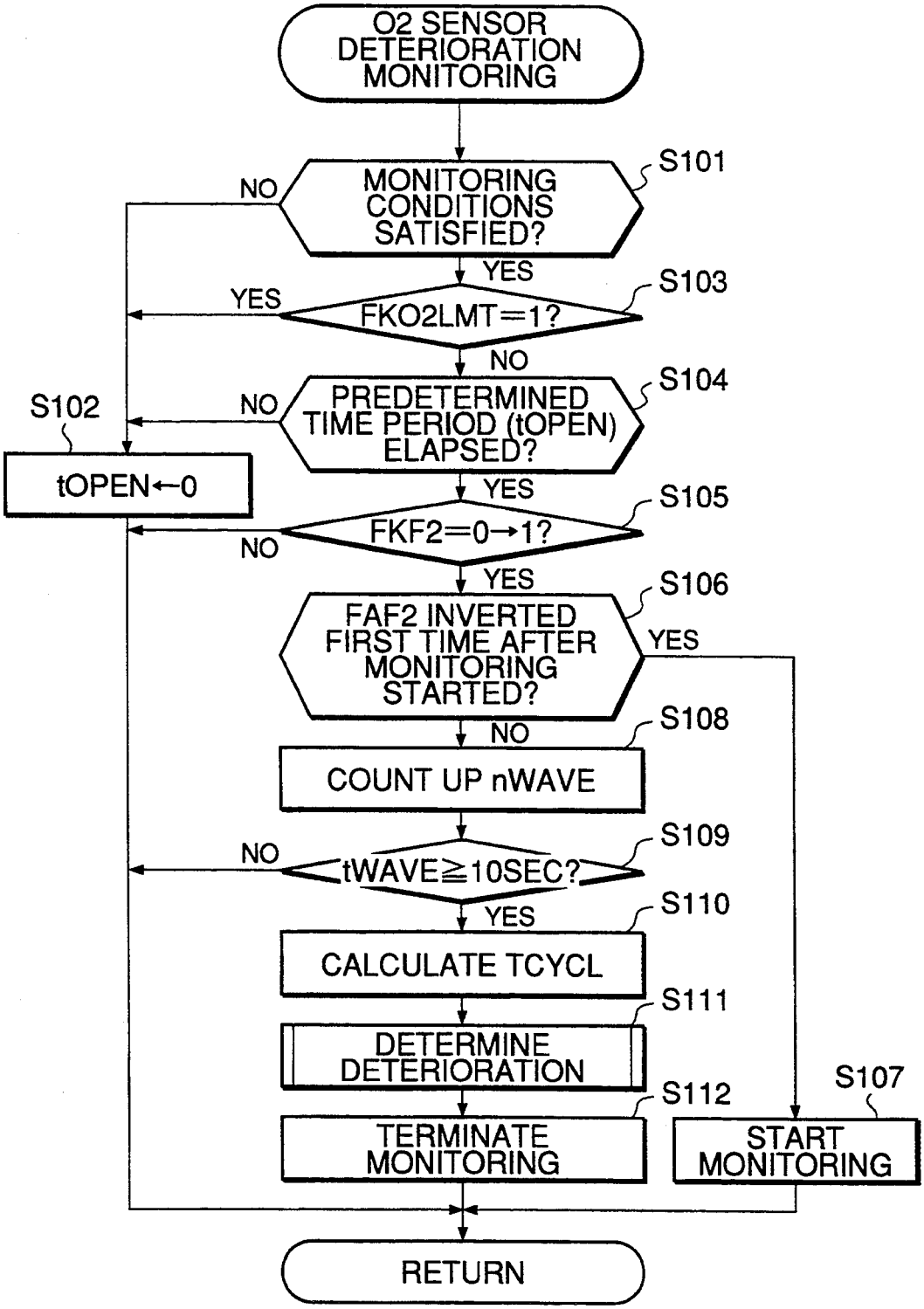
FIG. 3 is a flowchart showing a main routine for monitoring deterioration of the upstream O2 sensor.

FIG. 3 shows a program for carrying out monitoring of deterioration of the upstream O2 sensor 14F.

First, at a step S101, it is determined whether or not monitoring conditions, hereinafter described, under which the deterioration monitoring can be carried out are satisfied. If the monitoring conditions are not satisfied, the program proceeds at a step S102, where a counter (upcounter), not shown, for measuring a predetermined time period tOPEN is reset to "0" and started, and then the program is immediately terminated. If the monitoring conditions are satisfied, the program proceeds to a step S103.

At the step S103, it is determined whether or not a flag FKO2LMT, appearing in FIG. 11, hereinafter referred to, which is set to "1" when the KO2 value is held at the upper limit value or the lower limit value, has been set to "1". If the flag FKO2LMT has been set to "1", the program is terminated after execution of the step S102. If the flag KO2LMT has been set to "0", it is determined at a step S104 whether the predetermined time period tOPEN (e.g. 10 sec) has elapsed. If the predetermined time period tOPEN has not elapsed, the program is terminated after execution of the step S102.

If the predetermined time period tOPEN has elapsed, it is determined that the predetermined time period tOPEN has elapsed after the KO2 value, which had been held at the upper limit value or the lower limit value, returned to an intermediate value within the predetermined range defined by the upper and lower limit values, which means that the air-fuel ratio control is now being stably carried out, followed by the program proceeding to a step S105.

At the step S105, it is determined whether or not a flag FAF2, referred to hereinafter (see FIG. 9), has been changed from "0" to "1". If the flag FAF2 remains equal to "0", the present routine is immediately terminated. On the other hand, if the flag FAF2 has been changed from "0" to "1", i.e. if a delay time CDLY1 has elapsed after the output FVO2 from the upstream O2 sensor 14F was inverted from a lean value to a rich value on the last occasion, the program proceeds to a step S106, where it is determined whether or not the inversion of the output from the upstream O2 sensor 14F has first taken place after the present monitoring of the O2 sensor 14F was permitted. If this determination is carried out for the first time, it is the first inversion after the monitoring of the upstream O2 sensor 14F has been permitted, so that the answer to the question is affirmative (YES), and then the program proceeds to a step S107, where the upstream O2 sensor 14F starts to be monitored, followed by terminating the program.

When the second and subsequent inversions of the O2 sensor output take place after the monitoring of the upstream O2 sensor 14F was permitted, the answer to the question of the step S106 is negative (NO), and then the program proceeds to a step S108, where the number nWAVE of times of inversion is counted, i.e. the number nWAVE is increased by an increment of 1 whenever an inversion takes place, and then at a step S109, it is determined whether or not a time period tWAVE measured after the monitoring started exceeds a predetermined value (e.g. 10 sec.). If the answer to this question is negative (NO), the present routine is immediately terminated, whereas if the answer is affirmative (YES), the program proceeds to a step S110, where an inversion period TCYCL is calculated by the use of the following equation (2):

$$TCYCL = tWAVE/nWAVE \quad (2)$$

In this connection, a counter (upcounter) for measuring the time period tWAVE is reset to "0" and started when the monitoring is started at the step S107. Similarly, a counter (upcounter) for measuring the number nWAVE is reset and started at the step S107.

After the inversion period TCYCL is calculated at the step S110, a deterioration determination, described in detail hereinafter, is carried out at a step S111 to determined deterioration of the upstream O2 sensor 14F. The results of the determination i.e. the monitoring are stored into the memory means 5c, followed by terminating the present program.

Figure 4:
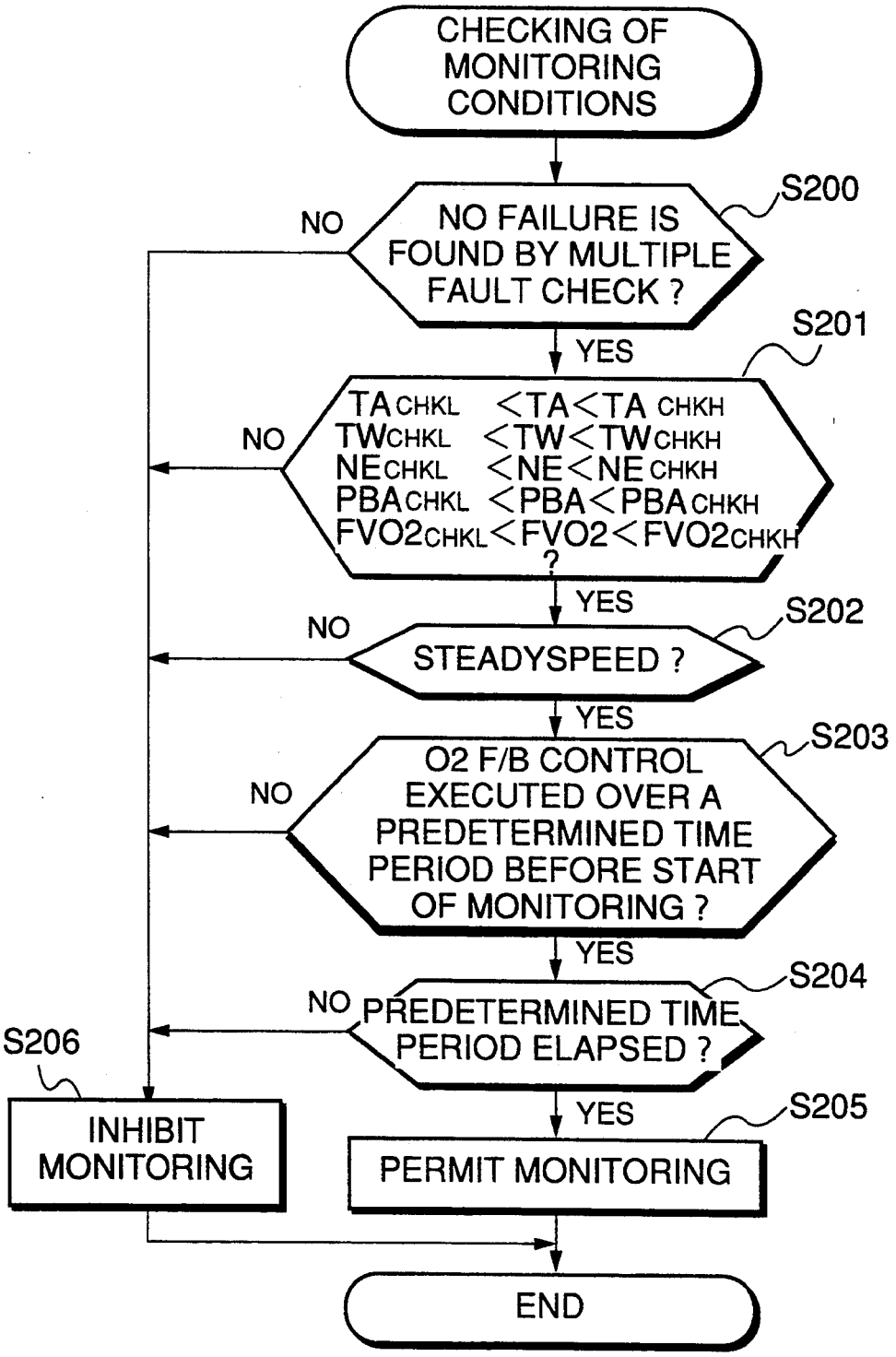
FIG. 4 is a flowchart showing a subroutine for determining whether or not monitoring conditions (preconditions) are satisfied for starting the monitoring of an output from the upstream O2 sensor.

FIG. 4 shows a monitoring condition fulfillment-determining subroutine which is executed at the step S101 of the FIG. 3 program. First, at a step S200, a multiple fault check, described in detail hereinafter, is carried out, and then at a step S201, operating conditions of the engine 1 are determined. More specifically, it is determined whether or not an output TA from the intake air temperature sensor 8 falls within a predetermined range TACHKL to TACHKH (e.g. 60° C. to 100° C.), whether or not an output TW from the coolant temperature sensor 9 falls within a predetermined range TWCHKL to TWCHKH (e.g. 60° C. to 100° C.), whether or not an output NE from the engine rotational speed sensor 10 falls within a predetermined range NECHKL to NECHKH (e.g. 2800 rpm to 3200 rpm), whether or not an output RBA from the intake pipe absolute pressure sensor 7 falls within a predetermined range PBACHKL to PBACHKH (e.g. −350 mmHg to −250 mmHg), and whether or not the output FVO2 from the upstream O2 sensor FVO2 falls within a predetermined range FVO2CHKL to FVO2CHKH. Then, it is determined at a step S202 whether or not the vehicle speed VH from the vehicle speed sensor 11 has continuously been within a variation range of 0.8 km/sec over a predetermined time period (e.g. 2 seconds). Then, it is determined at a step S203 whether or not the air-fuel ratio feedback control had been carried out over a predetermined time period (e.g. 10 sec.) before the monitoring was permitted at the step S203. Further, it is determined at a step S204 whether or not all the above conditions have continued to be satisfied over a predetermined time period (e.g. 2 sec.).

Then, if the answers to the questions of the above steps S200 to S204 are all affirmative (YES), the monitoring of the upstream O2 sensor 14F is permitted at a step S205, and then the program proceeds to a step S103 in FIG. 3, whereas if any of them is negative (NO), the monitoring of same is inhibited at a step S206, followed by terminating the main routine of FIG. 3.

Then, the multiple fault check, which is executed at the step S200 of the monitoring condition fulfillment-determining subroutine in FIG. 4, will be described in detail with reference to FIG. 5.

Figure 5:
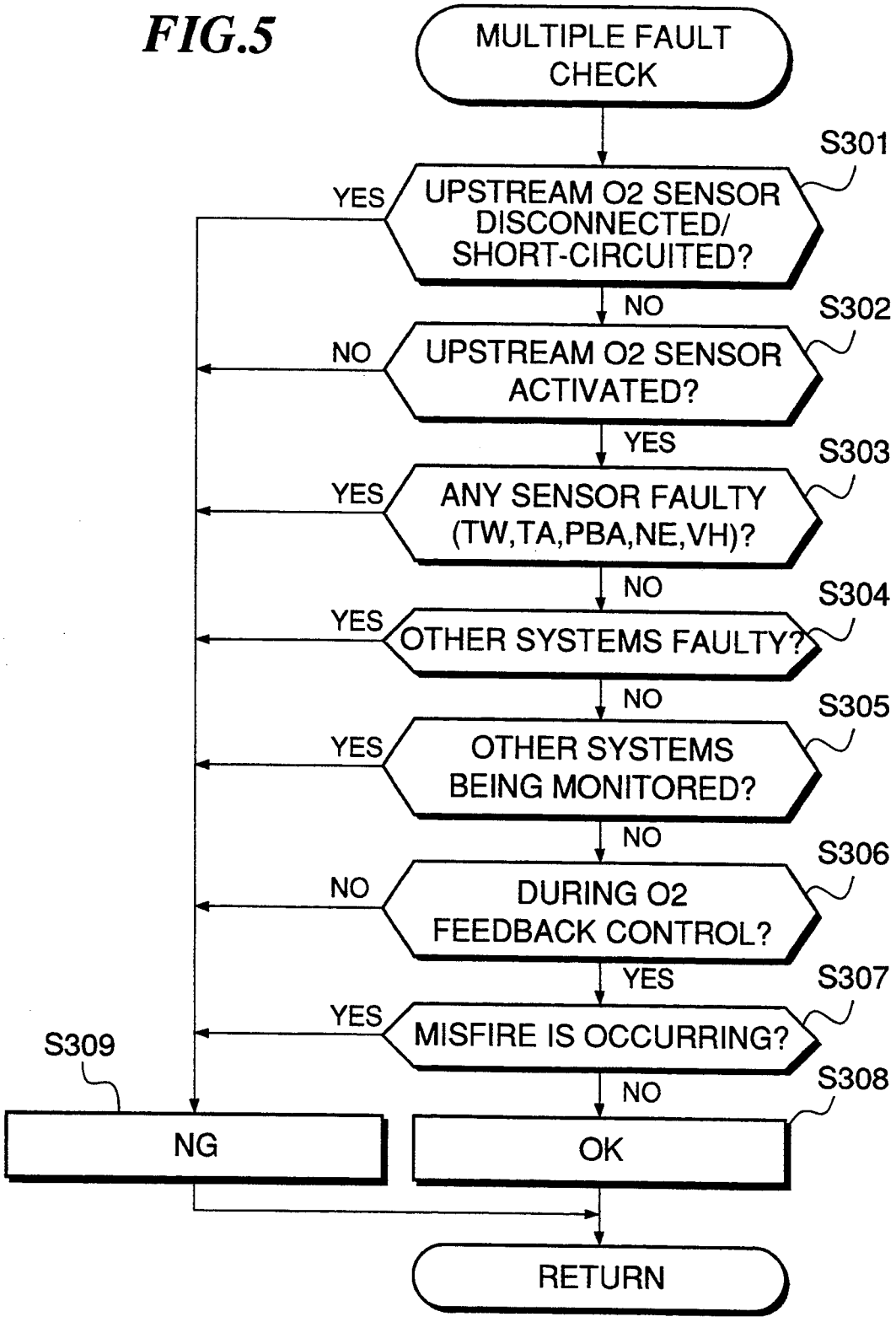
FIG. 5 is a flowchart showing a subroutine for executing a multiple fault check at a step of the FIG. 4 subroutine.

In FIG. 5, first, at a step S301, it is determined whether or not the upstream O2 sensor 14F is disconnected or short-circuited. If the answer to this question is negative (NO), the program proceeds to a step S302, where it is determined whether or not the upstream O2 sensor 14F has been activated. These determinations at the steps S301 and S302 are carried out by checking an output voltage from the upstream O2 sensor 14F, and by measuring the internal impedance of the upstream O2 sensor 14F by applying a predetermined voltage thereto. If the answer to the question of the step S302 is affirmative (YES), i.e. if the upstream O2 sensor 14F is neither disconnected nor short-circuited and at the same time it has been activated, the program proceeds to a step S303.

At the step 303, it is determined whether or not various sensors are abnormal. More specifically, it is determined whether or not any of the PBA sensor 7, the TA sensor 8, the TW sensor 9, the VH sensor 17, and the NE sensor 10 is abnormal. This determination is made by checking disconnection/short-circuit, etc., based on an output voltage from each sensor. If it is determined that there is no abnormality in any of these sensors, the program proceeds to a step S304.

At the step S304, it is determined whether or not the downstream O2 sensor 14R, the evaporative emission control system 31–34, the EGR system 17, and the fuel supply system (including the fuel injection valves 6) are abnormal, and further whether or not the rate of occurrence of misfires has reached a predetermined value. The determination as to abnormality of the downstream O2 sensor 14R is made by checking occurrence of a disconnection/short-circuit, based on whether or not the output voltage falls outside a predetermined range. The determination as to the evaporative emission control system is made by checking occurrence of leakage of evaporative fuel from the fuel tank 31 etc. The determination as to the fuel supply system is made by checking whether or not there is a deviation of the fuel supply amount from a controllable range thereof. If no abnormality is found in any of the sensor and systems, and at the same time the rate of occurrence of misfires has not reached the predetermined value, the program proceeds to a step 305.

At the step S305, it is determined, by executing a monitoring execution control program described hereinafter with reference to FIG. 6, whether or not monitoring of any of various devices (such as the catalyst 13) and systems (such as the evaporative emission control system and the fuel supply system) is being executed for detecting abnormality thereof. If the answer to this question is negative (NO), the program proceeds to a step S306, where it is determined whether or not the air-fuel ratio feedback control is being carried out. If the air-fuel ratio control is being carried out, it is determined at a step S307 whether or not a misfire has been just detected. If no misfire has been detected, it is determined at a step S308 that the results of the multiple fault check are good.

If it is determined that the results of the multiple fault check are good, the answer to the question of the step S200 are affirmative (YES), and then the program proceeds to the step S201.

On the other hand, if any of these steps S301, S303 to S305, and S307 is affirmative or if either of the step S302 or S306 is negative (NO), i.e. if the upstream O2 sensor 14F is disconnected/short-circuited, or has not been activated, any of the sensors, the evaporative emission control system, the EGR system 17 and the fuel supply system is abnormal, or if the rate of occurrence of misfires has reached or exceeded the predetermined value, or monitoring of the sensors and systems is being executed, or the air-fuel ratio feedback control is not being carried out, or a misfire has been just detected, it is determined at a step S409 that the results of the multiple fault check are not good for executing the monitoring of the upstream O2 sensor deterioration, and accordingly it is determined at the step S206 in FIG. 4 that the monitoring should be inhibited.

Figure 6:
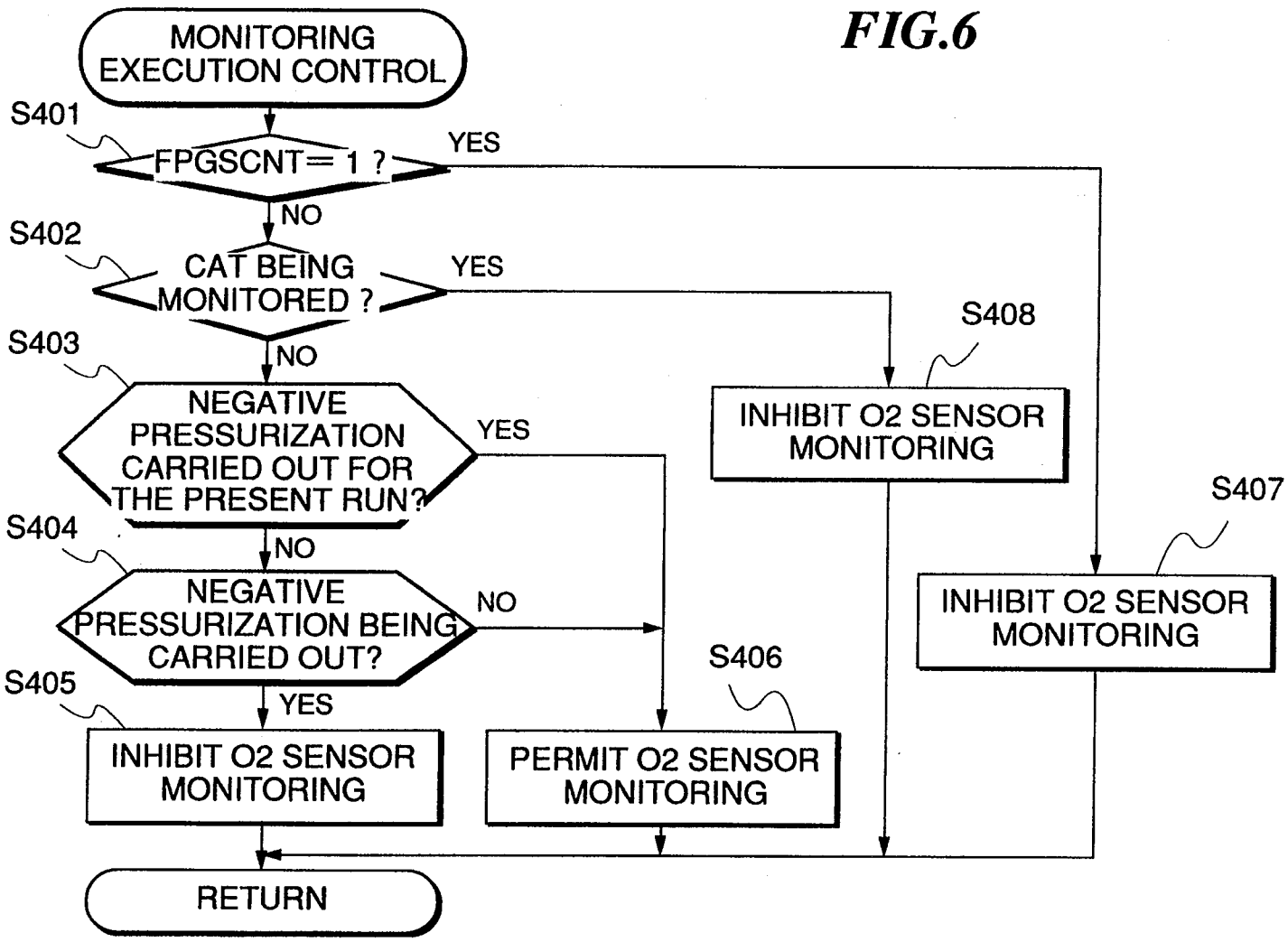
FIG. 6 is a flowchart showing a subroutine for executing a monitor execution control at a step of the FIG. 5 subroutine.

FIG. 6 shows details of the monitoring execution control program executed at the step S305 in the FIG. 5 routine.

First, at a step S401, it is determined whether or not a flag FPGSCNT has been set to "1" to indicate the status of execution of a purge cut for monitoring the fuel supply system. If the flat FPGSCNT has been set to "0", which means that the purge cut for monitoring the fuel supply system is not being carried out, the program proceeds to a step S402, wherein it is determined whether or not abnormality of the catalyst 13 is being checked. If the answer to this question is negative (NO), the program proceeds to a step S403.

At the following steps S403 to S404, it is determined whether or not the evaporative emission control system is being monitored. More specifically, the monitoring of this system is carried out by the following steps: an open-to-atmosphere step in which the system is relieved to the atmosphere, a tank internal pressure variation-checking step in which the fuel tank is closed and isolated from the rest of the system and a variation in the tank internal pressure, i.e. the pressure of evaporative fuel within the tank is measured to check an amount of evaporative fuel generated in the fuel tank, a tank internal pressure-reducing step in which the system is negatively pressurized to a predetermined negative level by utilizing negative pressure created within the intake pipe 2, and a leak down check step in which the tank internal pressure being restored from the predetermined negative level is checked to determine a leakage of evaporative fuel from the system.

At the step S403, it is determined whether or not the tank internal pressure-reducing step has been carried out at least one time after the vehicle started to run. If the answer to this question is negative (NO), i.e. if the tank internal pressure-reducing step has not yet been carried out, the program proceeds to a step S404, wherein it is determined whether or not the tank internal pressure-reducing step is currently being carried out. If the answer to this question is affirmative (YES), the monitoring of the O2 sensor is inhibited at a step S405 since the air-fuel ratio is liable to change due to negative pressurization of the evaporative emission control system if the monitoring is executed.

If the answer to the question of the step S404 is negative (NO), the program proceeds to a step S406, wherein the monitoring of the upstream O2 sensor 14F is permitted.

On the other hand, if the answer to the question of the step S403 is affirmative (YES), the program also proceeds to the step S406 to permit the monitoring of the upstream O2 sensor.

If the answer to the question of the step S401 is affirmative (YES), i.e. if the flag FPGSCNT is equal to "1", the program proceeds to a step S407, wherein the monitoring of the upstream O2 sensor is inhibited since the purge cut of evaporative fuel is being carried out for monitoring the fuel supply system and hence the air-fuel ratio is liable to change if the monitoring is executed. If the answer to the question of the step S402 is affirmative (YES), i.e. if the catalyst 13 is being checked for abnormality thereof, the monitoring of the upstream O2 sensor is inhibited at a step S408 since the air-fuel ratio control based on the output from the downstream O2 sensor alone is carried out for detecting abnormality of the catalyst 13, so that even if the upstream O2 sensor is normally functioning, the repetition period of inversion of the output from the upstream O2 sensor will become long, leading to an erroneous detection of abnormality thereof if the monitoring of the upstream O2 sensor is executed.

As is clear from the above, at the steps S405, S407, and S408, the monitoring of the upstream O2 sensor is not permitted when the evaporative emission control system, the fuel supply system, and the catalytic converter 13 are being monitored. Accordingly, the answer the the question of the step S305 in the FIG. 5 routine becomes affirmative (YES), so that the results of the multiple fail check by the FIG. 5 routine are not good (NG). The monitoring of the upstream O2 sensor is permitted at the step S406 of the FIG. 6 routine, only when none of the evaporative emission control system, the fuel supply system and the catalytic converter 13 are being monitored. Accordingly, the answer to the question of the step S305 becomes negative (NO), and then the program proceeds to the step S306.

Figure 7:
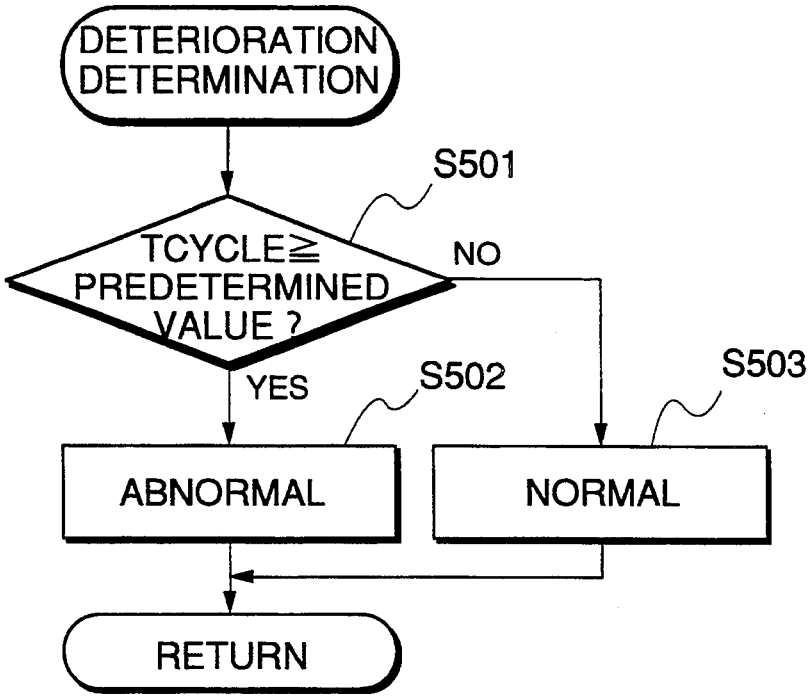
FIG. 7 is a flowchart showing a subroutine for executing determination of an O2 sensor deterioration at a step of the FIG. 3 main routine.

FIG. 7 shows a subroutine for carrying out the determination of deterioration of the upstream O2 sensor 14F which is executed at the step S111 of the FIG. 3 subroutine.

This subroutine is carried out by the upstream O2 sensor deterioration-determining means 52 in FIG. 2. First, at a step S501, it is determined whether or not the inversion period TCYCL calculated at the step S110 of the FIG. 3 program exceeds a predetermined value. If the answer to the question is affirmative (YES), it is determined at a step S502 that the upstream O2 sensor 14F is abnormal, and at the same time the alarming means 46 is actuated to light the LED thereof, followed by terminating the present routine. If the answer to the question of the step S501 is negative (NO), i.e. if the inversion period TCYCL is shorter than the predetermined value, the program proceeds to a step S503, wherein it is determined that the upstream O2 sensor 14F is normal, followed by terminating the routine. In this connection, the predetermined value may be set to proper values depending on operating conditions of the engine, to further improve the accuracy of abnormality detection.

Next, description will be made of details of the air-fuel ratio feedback control based on the outputs from the upstream and downstream O2 sensors 14F, 14R (hereinafter referred to as "the 2-O2 sensor F/B control").

Figure 8:
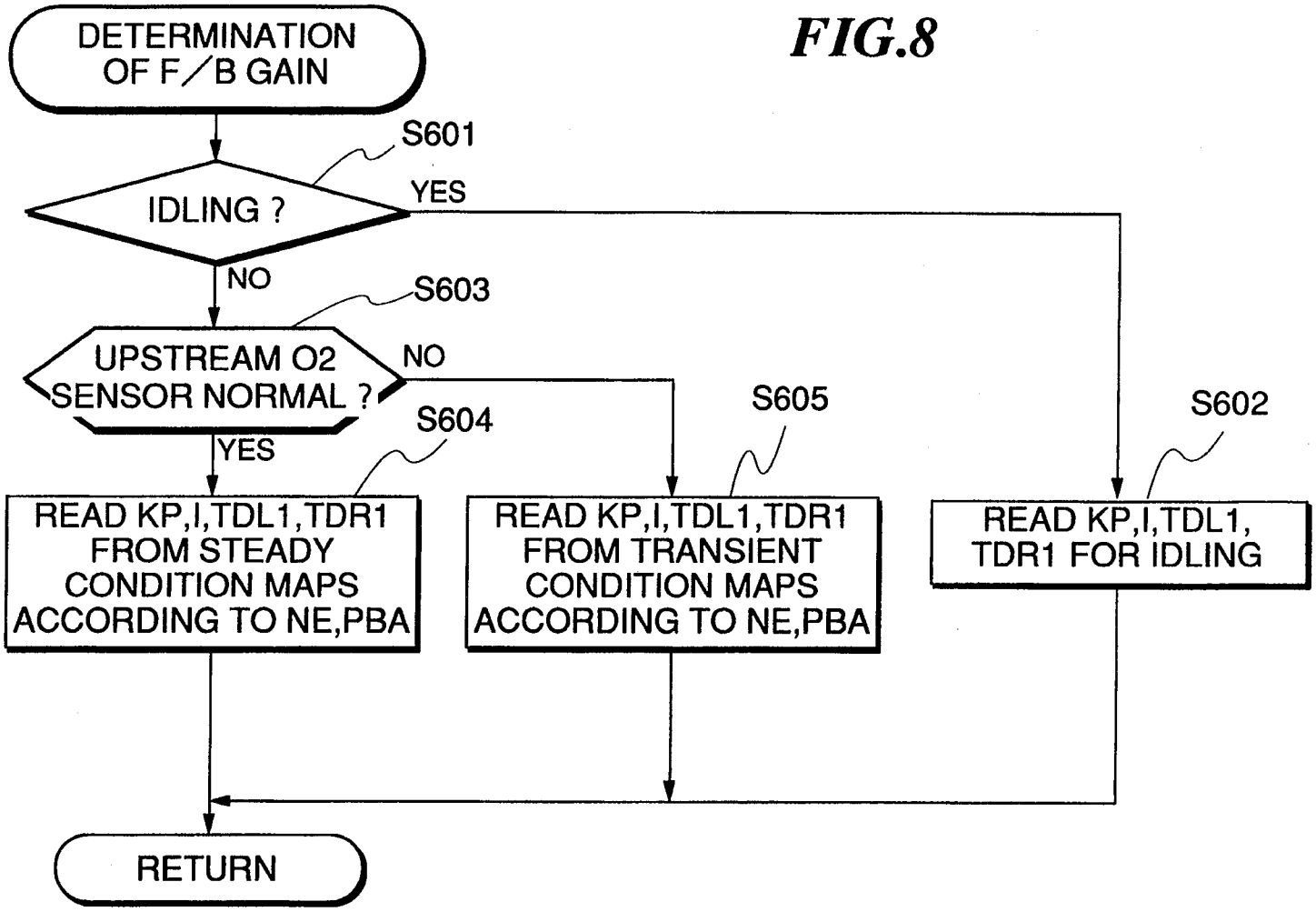
FIG. 8 is a flowchart showing a routine for calculating a feedback gain to be applied in the air-fuel ratio feedback control based on the output from the upstream O2 sensor.

FIG. 8 shows a program for determining a feedback gain used in the 2-O2 sensor F/B control responsive to the output from the upstream O2 sensor 14F. Basically, the feedback gain is determined based on the engine rotational speed NE and the intake pipe absolute pressure PBA.

First, at a step S601, it is determined whether or not the engine is in an idling condition. If it is determined that the engine is idling, a proportional term (P term) coefficient KP, an integral term (I term) I, and a delay time factor TDL1 (which corresponds to P term-adding delay time) and a delay time factor TDR14 (which corresponds to P term-subtracting delay time), which are to be applied when the engine is idling, are read from maps for idling at a step S602, followed by terminating the program. If it is determined at the step S601 that the engine is not idling, the program proceeds to a step S603.

At the step S603, it is determined whether or not the output from the upstream O2 sensor 14F is in a steady state. This determination is carried out by determining whether or not the engine coolant temperature TW is low, whether or not variation in the engine rotational speed NE is large, whether or not variation in the intake pipe absolute pressure PBA is large, whether or not variation in the throttle valve opening $\theta$TH is large, etc. If the output upstream O2 sensor 14F is in a steady state, the coefficient KP, integral term I, delay time factor TDL1, and delay time factor TDR1 are determined at a step S604 by retrieving respective maps (hereinafter referred to as "the steady condition maps) according to the engine rotational speed NE and the intake pipe absolute pressure PBA, followed by terminating the program. The steady condition maps are set such that values of the coefficient KP, the integral term I, and the delay time factors TDL1, TDR1 suitable for steady conditions of the engine 1 are provided correspondingly to values of the engine rotational speed NE and the intake pipe absolute pressure PBA.

If the answer to the question of the step S603 is negative (NO), i.e. if the output from the upstream O2 sensor 14F is in a transient state, the coefficient KP, the integral term I, and delay time TDL1, TDR1 are determined at a step S605 by retrieving respective maps (hereinafter referred to as "the transient condition maps) according to the engine rotational speed NE and the intake pipe absolute pressure PBA, followed by terminating the program. The transient condition maps are set such that values of the coefficient KP, the integral term I, the delay time factors TDL1, TDR1 suitable for transient conditions of the engine 1 are provided correspondingly to values of the engine rotational speed NE and the intake pipe absolute pressure PBA.

Figure 9:
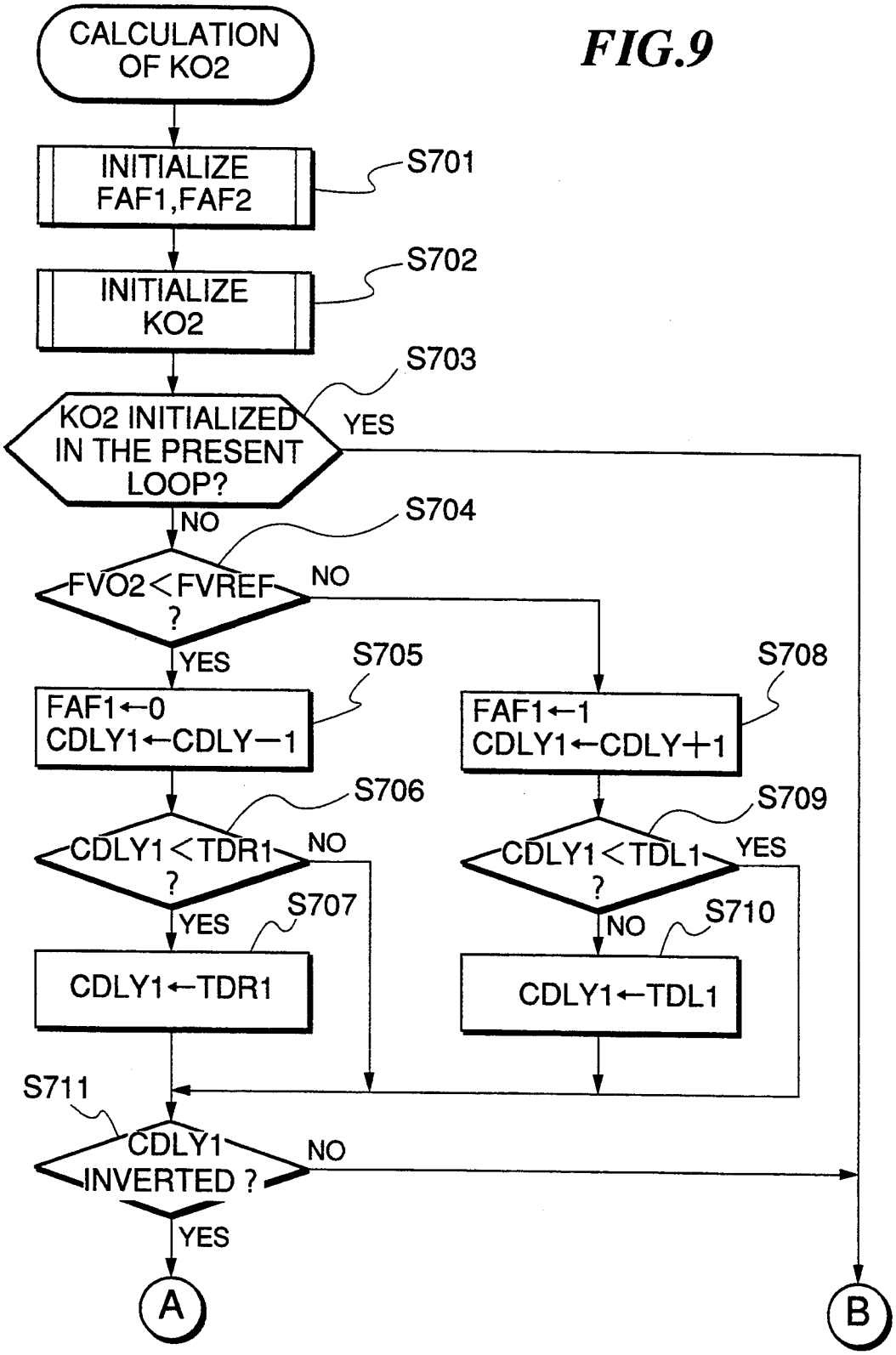
FIG. 9 is a flowchart showing a routine for calculating an air-fuel ratio correction coefficient KO2 applied in the air-fuel ratio feedback control carried out by the use of two O2 sensors.
Figure 10:
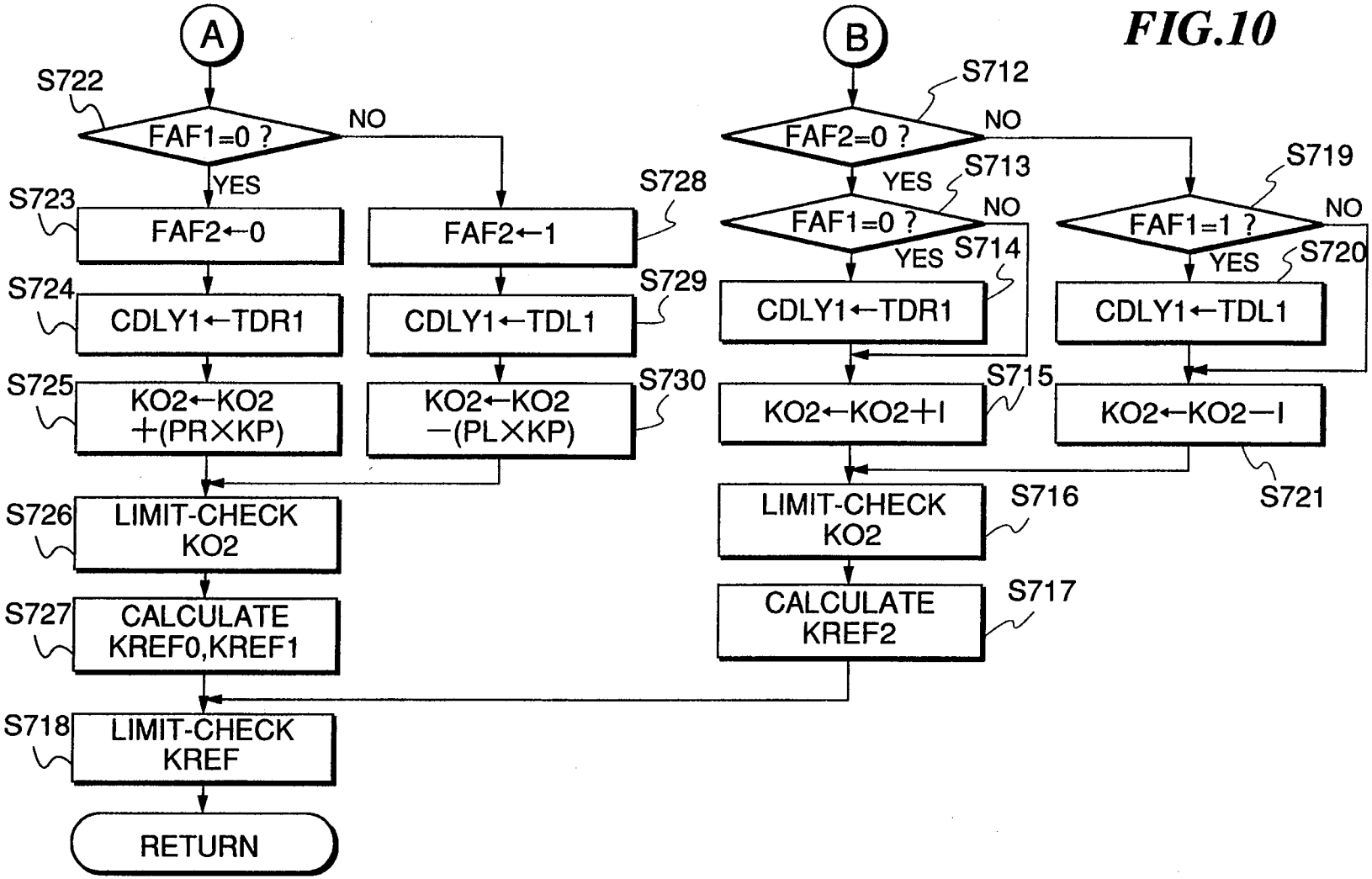
FIG. 10 is the remaining part of the FIG. 9 flowchart.

FIG. 9 and FIG. 10 show a program for calculating the air-fuel ratio correction coefficient KO2 applied during the 2-O2 sensor F/B control, which is executed at time intervals of 5 msec. Here, the air-fuel ratio correction coefficient KO2 is calculated based on the output FVO2 from the upstream O2 sensor 14F and the output RVO2 from the downstream O2 sensor 14R, such that the air-fuel ratio of the air-fuel mixture supplied to the engine becomes equal to a stoichiometric value ($\lambda=1$).

First, at a step S701, flags FAF1 and FAF2 are initialized. The flag FAF1 indicates lean and rich states of the output FVO2 from the upstream O2 sensor 14F, respectively, when set to "0" and "1", and the flag FAF2 indicates lean and rich states of the output FVO2 after the lapse of a predetermined delay time has been counted up by a counter CDLY, referred to hereinafter. Then, at a step S702, the air-fuel ratio correction coefficient KO2 is initialized (e.g. set to an average value KREF thereof), followed by the program proceeding to a step S703.

The steps S701 and S702 are carried out only once when the KO2-calculating program is started.

At the step S703, it is determined whether or not the air-fuel ratio correction coefficient KO2 ha just ben initialized in the present loop. If the answer to this question is negative (NO), the program proceeds to a step S704, where it is determined whether or not the upstream O2 sensor output FVO2 is lower than a reference value FVREF (threshold value for determining whether the output FVO2 is rich or lean). If the answer to this question is affirmative (YES), i.e. if FVO2<FVREF, it is determined that the output FVO2 indicates a lean value, and then the flag FAF1 is set to "0" at a step S705, and at the same time the count value CDLY1 of the counter CDLY for counting the P term-adding/subtracting delay time is decreased by a decrement of 1. More specifically, if FVO2<FVREF, the flap FAF1 is set to "0" and the count value CDLY1 of the counter CDLY is decreased by 1 whenever the present step is carried out. Then, at a step S706, it is determined whether or not the count value DCLY1 is smaller than the aforementioned delay time factor TDR1. If the answer to this question is affirmative (YES), i.e. if CDLY1<TDR1, the count value CDLY1 is set to the delay time factor TDR1 at a step S707.

On the other hand, if the answer to the question of the step S704 is negative (NO), i.e. if FVO2≧FVREF, which means that the output FVO2 indicates a rich value, the flap FAF1 is set to "1", and at the same time the count value CDLY1 is increased by an increment of 1 at a step S708. More specifically, if FVO2≧FVREF, the flap FAF1 is set to "1" and the count value CDLY1 of the counter CDLY is increased by 1 whenever the present step is carried out. Then, at a step S709, it is determined whether or not the count value CDLY1 is smaller than the aforementioned delay time factor TDL1. If the answer to this question is negative (NO), i.e. if CDLY1<TDL1, the count value CDLY1 is set to the delay time factor TDL1 at a step S710.

If the answer to the question of the step S706 is negative (NO), i.e. if CDLY1≦TDR1, the program skips over the step S707 to a step S711. Similarly, if the answer to the question of the step S709 is affirmative (YES), i.e. if CDLY1<TDL1, the program skips over the step S710 to the step S711.

At the step S711, it is determined whether or not the sign of the count value CDLY1 has been inverted. That is, it is determined whether or not the delay time factor TDR1 or TDL1 has been counted up after the output FVO2 from the upstream O2 sensor 14F crossed the reference value FVREF. Actually, the delay time factors TDR1 and TDL1 are negative and positive count values, respectively, and hence it is determined here whether or not a delay time period corresponding to the absolute value of the delay time factor TDR1 or that of the delay time factor TDL1 has elapsed after the output FVO2 crossed the reference value FVREF. If the answer to this question is negative (NO), i.e. if the delay time period TDR1 or TDL1 has not elapsed, the program proceeds to a step S712, where it is determined whether or not the flag FAF2 has been set to "0". If the answer to this question is affirmative (YES), it is determined at a step S713 whether or not the flag FAF1 has been set to "0". If the answer to this question is affirmative (YES), it is judged that the air-fuel ratio has continuously been lean, so that the program proceeds to a step S714, wherein the count value CDLY1 is set to the delay time factor TDL1, followed by the program proceeding to a step S715. If the answer to the question of the step S713 is negative (NO), it is judged that the delay time has not elapsed yet after the output FVO2 from the upstream O2 sensor was inverted from a lean side to a rich side, i.e. after it crossed the reference value FVREF, so that the program skips over the step S714 to the step S715.

At the step S715, a present value of the air-fuel ratio correction coefficient KO2 is obtained by adding the integral term I to a value of the coefficient KO2 calculated in the immediately preceding loop by the use of the following equation (3):

$$KO2=KO2+I \tag{3}$$

After execution of the step S715, limit-checking of the resulting value of the correction coefficient KO2 is performed by a method at a step S716, hereinafter described with reference to FIG. 11, calculation of a value KREF2 (learned value of the correction coefficient KO2 used in starting the vehicle) at a step S717, and limit-checking of the resulting value KREF2 at a step S718, followed by terminating the program.

On the other hand, if the answer to the question of the step S712 is negative (NO), i.e. if the flag FAF2 is equal to "1", it is further determined at a step S719 whether or not the flap FAF1 is equal to "1". If the answer to this question is affirmative (YES), it is judged that the air-fuel ratio has continuously been rich, and then at a step S720, the count value CDLY1 is set to the delay time factor TDL1 again, followed by the program proceeding to a step S721. On the other hand, if the answer to the question of the step S719 is negative (NO), it is judged that the delay time period has not elapsed yet after the output FVO2 from the upstream O2 sensor 14F was inverted from the rich side to the lean side, so that the program skips over the step S720 to a step S721. At the step S721, the present value of the correction coefficient KO2 is calculated by subtracting the integral term I from the immediately preceding value of the correction coefficient KO2 by the use of the equation (4):

$$KO2=KO2-I \tag{4}$$

Then, the above steps S716 to S718 are carried out, followed by terminating the routine.

Thus, when the sign of the count value CDLY1 of the counter CDLY has not been inverted, the status of the flag FAF2 is checked, and the correction coefficient KO2 is calculated based on the result of the check. Further, the status of the flag FAF1 is checked to determine whether the output FVO2 from the upstream O2 sensor 14F has been inverted from the lean side to the rich side or vice versa, and depending upon the result of this determination, the count value CDLY1 for measuring the delay time is increased by an increment of 1 or decreased by a decrement of 1, or it is held at the predetermined delay time factor (TDR1 or TDL1).

On the other hand, if the answer to the question of the step S711 is affirmative (YES), i.e. if the sign of the count value CDLY1 has been inverted, that is, if a time period corresponding to the absolute value of the delay time factor TDR1 or the delay time factor TDL1 has elapsed after the output FVO2 from the upstream O2 sensor 14F was inverted from the lean side to the rich side or vice versa, the program proceeds to a step S722, where it is determined whether or not the flag FAF1 is equal to "0", i.e. whether or not the output FVO2 from the upstream O2 sensor 14F indicates a lean value. If the answer to the question of the step S722 is affirmative (YES), i.e. if FAF1=0 (the output FVO2 indicates a lean value), the program proceeds to a step S723, wherein the flag FAF2 is set to "0", and then at a step S724, the count value CDLY1 is set to the delay time factor TDR1, followed by the program proceeding to a step S725.

At the step S725, the present value of correction coefficient KO2 is calculated by adding the product of a proportional term PR and the coefficient KP to the immediately preceding value of correction coefficient KO2 by the use of the following equation (5):

$$KO2=KO2+(PR\times KP) \quad (5)$$

where KO2 on the right side represents the immediately preceding value of the correction coefficient KO2, and the proportional term PR a correction term employed for shifting the air-fuel ratio toward the rich side by increasing the correction coefficient KO2 in a stepped manner when the delay time period corresponding to the count value TDL1 has elapsed after the output FVO2 from the upstream O2 sensor 14F was inverted from the rich side to the lean side, and is varied according to the output RVO2 from the downstream O2 sensor 14R (A manner of calculation thereof will be described hereinbelow). Further, the coefficient KP is set at the aforementioned step S602, S604, or S605.

Then, limit-checking of the correction coefficient KO2 is carried out at a step S726, and a value KREF0 (average value of the correction coefficient KO2 calculated when the engine is idling) and a value KREF1 (average value of the correction coefficient KO2 calculated when the engine is not idling) are calculated at a step S727. Then, the program proceeds to the step S718, followed by terminating the program.

If the answer to the question of the step S722 is negative (NO), i.e. if the output FVO2 from the upstream O2 sensor 14F indicates a rich value (FAF1=1), the program proceeds to a step S728, wherein the flag FAF2 is set to "1", and then at a step S729, the count value CDLY1 is set to the delay time factor TDL1, followed by the program proceeding to a step S730.

At the step S730, the present value of the correction coefficient KO2 is calculated by subtracting the product of the proportional term PL and the coefficient KP from the immediately preceding value of the correction coefficient KO2 by the use of the following equation:

$$KO2=KO2=(PL\times KP) \quad (6)$$

where KO2 on the right side represents the immediately preceding value of the correction coefficient KO2, and the proportional term PL a correction term employed for shifting the air-fuel ratio toward the lean side by decreasing the correction coefficient KO2 in a stepped-up manner when the delay time factor TDR1 has elapsed after the output FVO2 from the upstream O2 sensor 14F has been inverted from the lean side to the rich side with respect to a stoichiometric value, and is varied according to the output RVO2 from the downstream O2 sensor 14R (the manner of calculation thereof will be described hereinbelow). Further, the coefficient KP assumes a value set at the aforementioned step S602, S604, or S605.

Then, the steps S726, S727 and S718 are sequentially carried out, followed by terminating the program. Thus, the timing of generation of the integral term I and the proportional term PR or PL of the correction coefficient KO2 is calculated based on the output FVO2 from the upstream O2 sensor 14F. Further, in FIG. 9, when the air-fuel ratio feedback control is started, the average value KREF is set as an initial value of the correction coefficient KO2 at the step S702, and then the program proceeds to the step S703. Since the answer to the question of the step S703 is affirmative (YES) in this case, the program proceeds therefrom to the steps S712 to S721 to calculate the correction coefficient KO2, followed by terminating the program.

Figure 11:
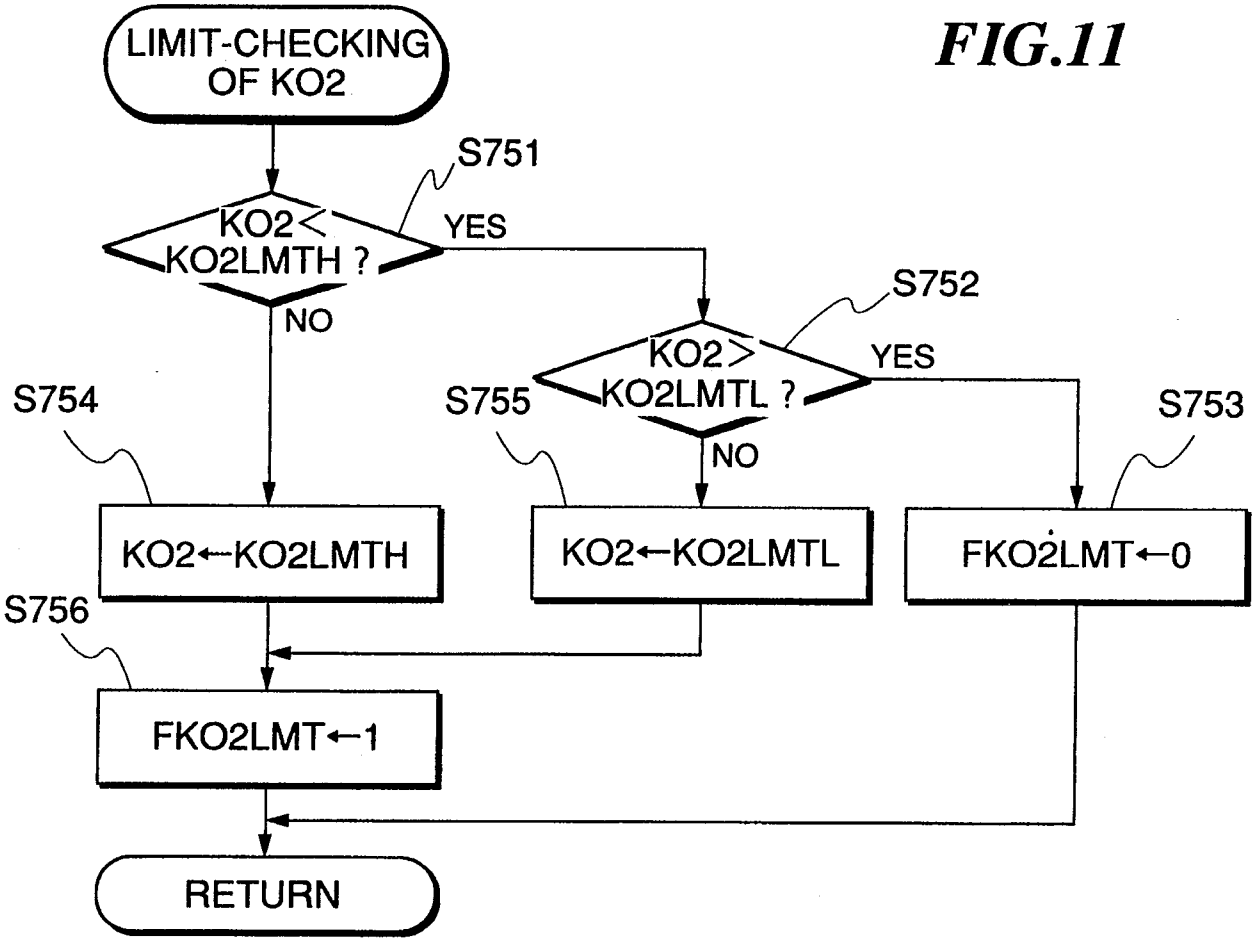
FIG. 11 is a flowchart for executing a KO2 limit-check.

FIG. 11 shows a program for carrying out the limit-checking of the KO2 value which is executed at the steps S716 and S726 in FIG. 10.

First, at a step S751, it is determined whether or not the KO2 value is smaller than an upper limit value KO2LMTH. If the former is smaller than the latter, the program proceeds to a step S752, wherein it is determined whether or not the KO2 value is larger than a lower limit value KO2LMTL. If the former is larger than the latter, i.e. if KO2LMTL<KO2<KO2LMTH, the flag FKO2LMT is set to "0" at a step S753, followed by terminating the program.

On the other hand, if the answer to the question of the step S751 is negative (N)), i.e. if KO2≧KO2LMTH, or if the answer to the question of the step S752 is negative (NO), i.e. if KO2≦KO2LMTL, the KO2 value is set to the upper limit value KO2LMTH at a step S754 or set to the lower limit value O2LMTL at a step S755, and then the flag FKO2LMT is set to "1" at a step S756, followed by terminating the program.

Figure 12:
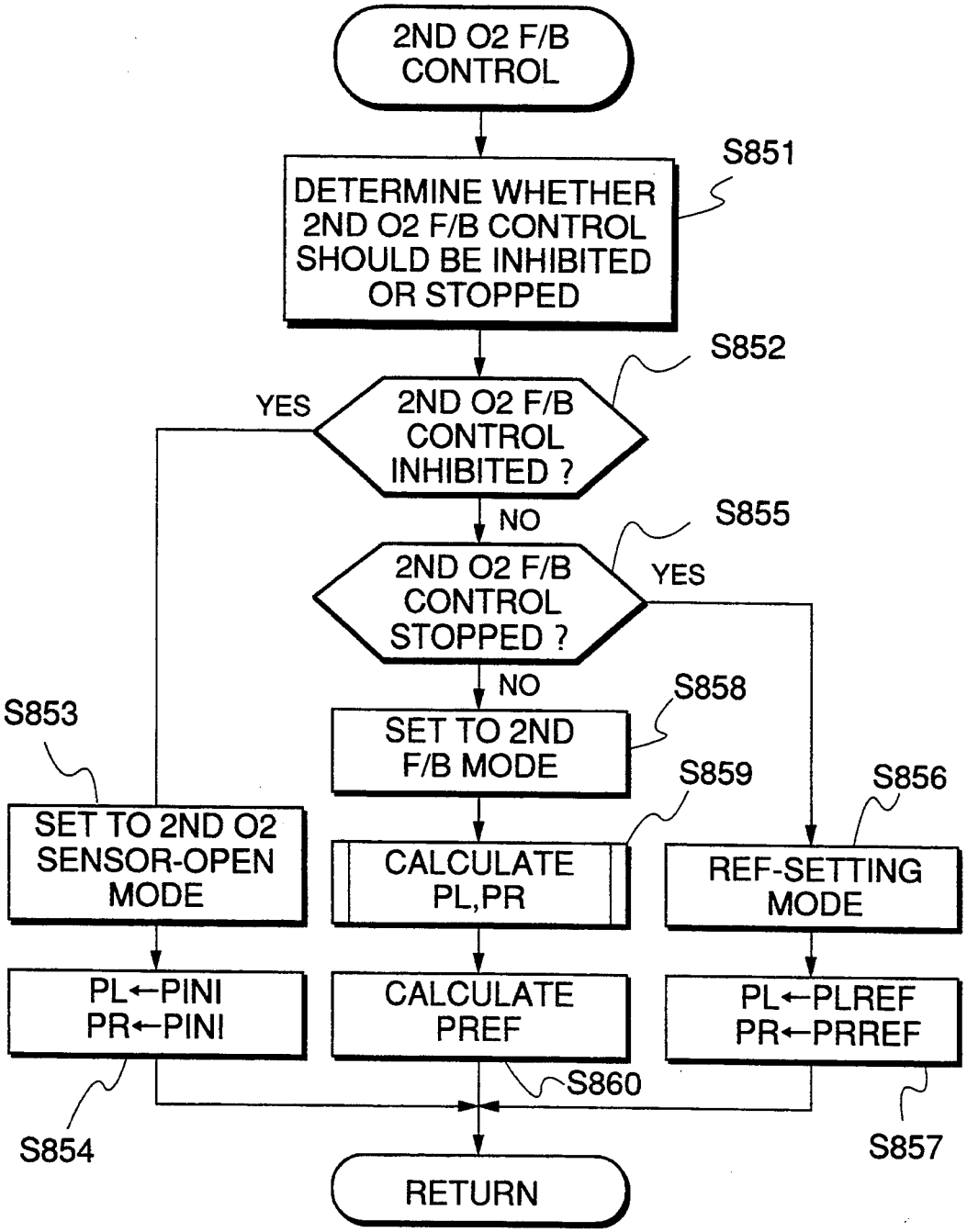
FIG. 12 is a flowchart showing a main routine for executing the air-fuel ratio feedback control based on an output from a downstream O2 sensor.

FIG. 12 shows a main routine for carrying out the air-fuel ratio feedback control based only on the output from the downstream O2 sensor 14R, which is executed at time intervals of 100 msec. This program is for correcting a deviation in the control amount (KO2) based on the the output FVO2 from the upstream O2 sensor 14F, by the use of the output RVO2 from the downstream O2 sensor 14R.

First, at a step S851, a feedback control execution-determining processing is carried out for determining whether or not the air-fuel ratio feedback control (hereinafter referred to as "2nd O2 F/B control") based on the output RVO2 from the downstream O2 sensor 14R should be inhibited or stopped temporarily. According to the result of this determination, at a step S852, it is determined whether or not the 2nd O2 F/B control is being inhibited. If the answer to the question is affirmative (YES), the program proceeds to a step S853, wherein the air-fuel ratio control is set to a downstream O2 sensor-open mode, and then the proportional terms PL and PR are both set to an initial value PINI of the proportional term at a step S854, followed by terminating the program.

If the answer to the question of the step S852 is negative (NO), it is determined at a step S855 whether or not the 2nd O2 F/B control is being temporarily stopped. If the answer to this question is affirmative (YES), the air-fuel ratio control is set to a REF-setting mode at a step S856, and then at a step S857 the proportional terms PL and PR are set to respective learned values PLREF, PRREF calculated by PREF calculation processing, described hereinafter.

If the answer to the question of the step S855 is negative (NO), the air-fuel ratio control is set to a 2nd O2 F/B mode at a step S858, and then at a step S859 the proportional terms PL and PR are calculated by a subroutine, described hereinafter. Further, the PREF-calculation processing is carried out at a step S860, followed by terminating the program.

Figure 13:
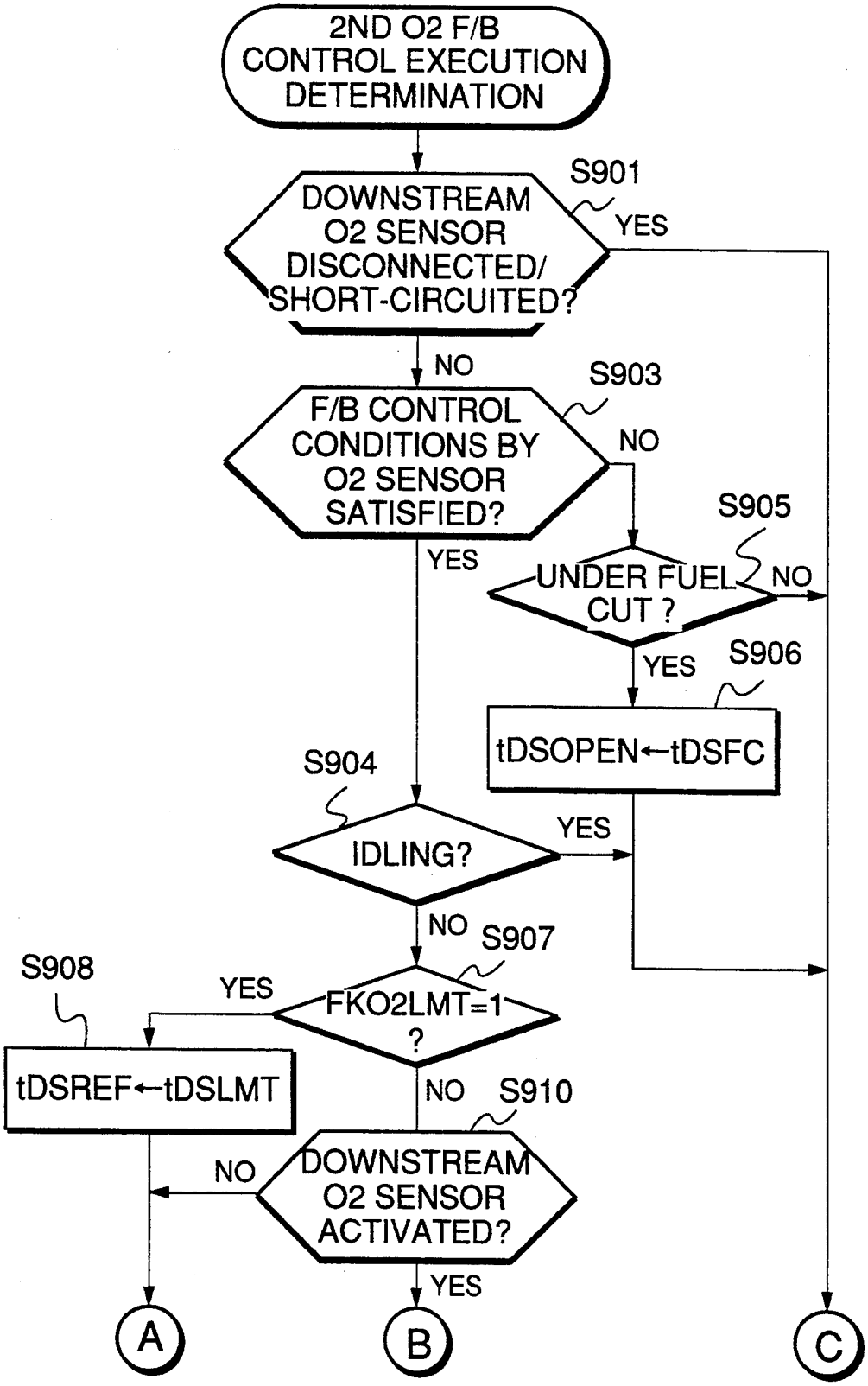
FIG. 13 is a flowchart for executing determination as to execution of the air-fuel ratio feedback control based on an output from a downstream O2 sensor.
Figure 14:
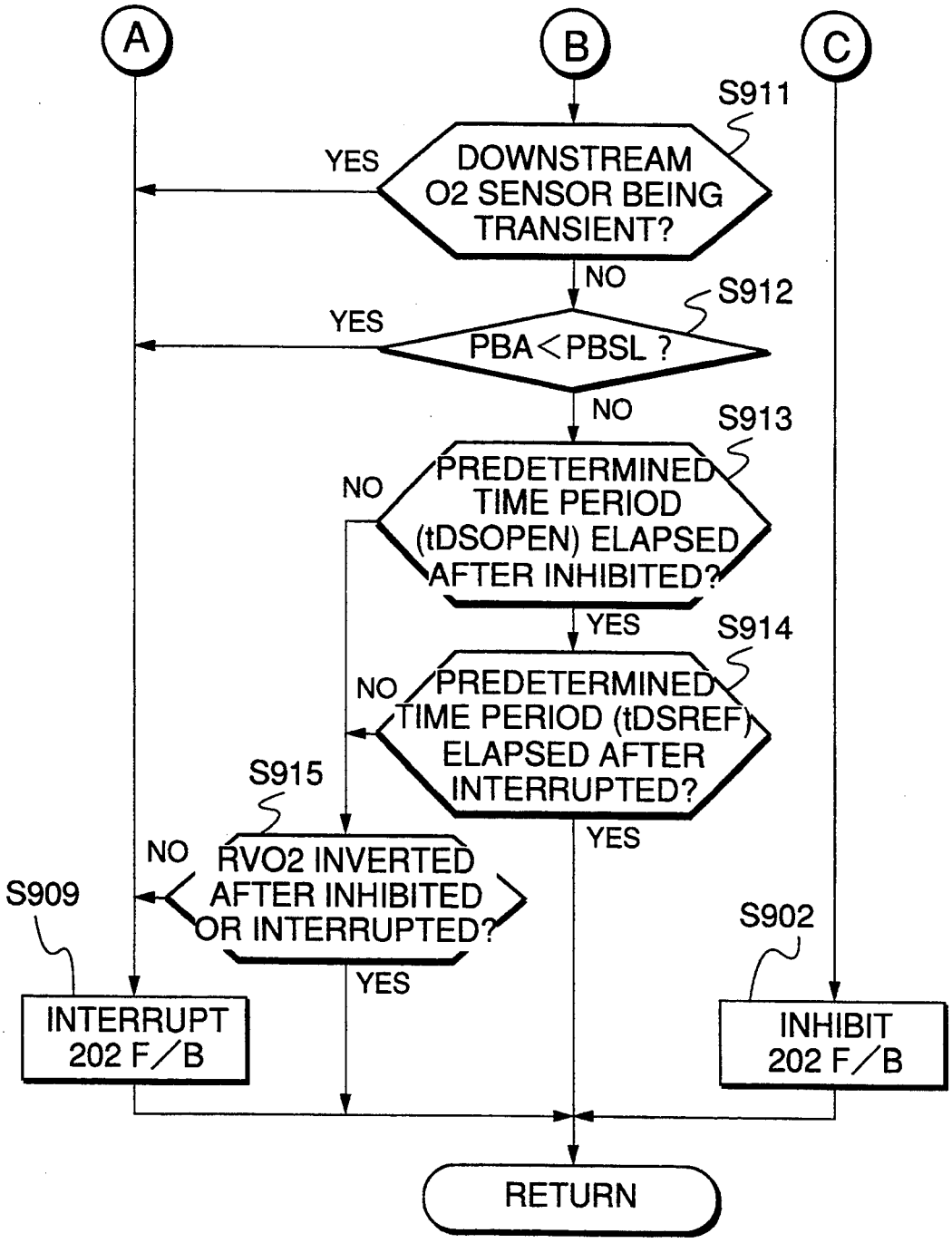
FIG. 14 is the remaining part of the FIG. 13 flowchart.

FIG. 13 and FIG. 14 show details of the subroutine executed at the step S851 in FIG. 12, for carrying out the determination as to whether the 2nd O2 F/B control should be executed.

First, at a step S901, it is determined whether or not the downstream O2 sensor 14F is disconnected/short-circuited. If the answer is affirmative (YES), the 2nd O2 F/B control is inhibited at a step S902, wherein as if the answer is negative (NO), it is determined at a step S903 whether or not conditions for carrying out the air-fuel ratio feedback control based on the output from the upstream O2 sensor 14F are satisfied. More specifically, the air-fuel ratio feedback control-effecting conditions are satisfied, e.g. when increase of the fuel injection amount is not being carried out under a high engine load condition (i.e. when the engine is in a medium load condition), the upstream O2 sensor 14F is activated and normally functioning, and at the same time the engine is not under fuel cut. If the conditions are satisfied, the program proceeds to a step S904, whereas if they are not satisfied, the program proceeds to a step S905.

At the step S904, it is determined whether or not the engine is idling. If the engine is idling, the 2nd O2 F/B control is inhibited at the step S902. At the step S905, it is determined whether or not the engine is under fuel cut. If the engine is not under fuel cut, the 2nd O2 F/B control is inhibited at the step S902. If the engine is under fuel cut, the program proceeds to a step S906, wherein a delay time period tDSOPEN over which the inhibition of the 2nd O2 F/B control is to be continued is set to a delay time period tDSFC applied at fuel cut, which determines a time period during which the 2nd O2 F/B control should be inhibited after termination of fuel cut, following by inhibiting the 2nd O2 F/B control at the step S902.

If the answer to the question of the step S904 is negative (NO), i.e. if the engine is not idling, the program proceeds to a step S907, wherein it is determined whether or not the aforementioned flag FKO2LMT is equal to "1". If the answer is affirmative (YES), i.e. if the KO2 value is held at the upper or lower limit value KO2LMTH or KO2LMTL, the program proceeds to a step S908, wherein a delay time period tDSREF over which the interruption of the 2nd O2 F/B control is to be continued is set to a delay time period tDSLMT applied when the KO2 value is held at the upper or lower limit value KO2LMTH or KO2LMTL, which determines a time period during which the interruption of the 2nd O2 F/B control should be continues after the KO2 value becomes held at the upper or lower limit value KO2LMTH or KO2LMTL, and then the 2nd O2 F/B control is interrupted at a step S909.

If the answer to the question of the step S907 is negative (NO), i.e. if the flag FKO2LMT is equal to "0", it is determined at a step S910 whether or not the downstream O2 sensor 14R is activated, and then at a step S911 whether or not the downstream O2 sensor 14R is in a transient state. The transient state of the downstream O2 sensor 14R includes a state in which the engine coolant temperature TW is low, a state in which the determination of deterioration of the catalyst 13 is being monitored, a state in which the intake pipe absolute pressure PBA is largely fluctuating, and a state in which the variation of the throttle valve opening $\theta$TH is large.

If the answer to the question of the step S910 is negative (NO), i.e. if the downstream O2 sensor 14R is not activated, the 2nd O2 F/B control is interrupted at the step S909. Similarly, if the answer to the question of the step S911 is affirmative (YES), i.e. if the downstream O2 sensor 14R is in the transient state, the 2nd O2 F/B control is interrupted at the step S909.

If the answer to the question of the step S911 is negative (NO), i.e. if the downstream O2 sensor 14R is in a steady state, the program proceeds to a step S912, wherein it is determined whether or not the intake pipe absolute pressure PBA is lower than a predetermined lower limit value PBSL. If the answer is affirmative (YES), it is judged that the engine is in a low load condition, and then the 2nd O2 F/B control is interrupted at the step S909, whereas if the answer is negative (NO), it is judged that the engine is in a medium or high load condition, and then the program proceeds to a step S913.

At the step S913, it is determined whether or not the predetermined time period tDSOPEN has elapsed after the 2nd O2 F/B control was inhibited. If the answer is affirmative (YES), it is determined at a step S914 whether or not a predetermined time period tDSREF has elapsed after the 2nd O2 F/B control was interrupted. If the answer to the question of either the step S913 or S914 is negative (NO), the program proceeds to a step S915, wherein it is determined whether or not the output RVO2 from the downstream O2 sensor 14R has been inverted. If the output RVO2 has not been inverted, the 2nd O2 F/B control is interrupted at the step S909, whereas if it has been inverted, the program is immediately terminated. If the answer to the question of the step S914 is affirmative (YES), i.e. if the predetermined time period tDSREF has elapsed after the interruption of the 2nd O2 F/B control, the program is immediately terminated.

Figure 15:
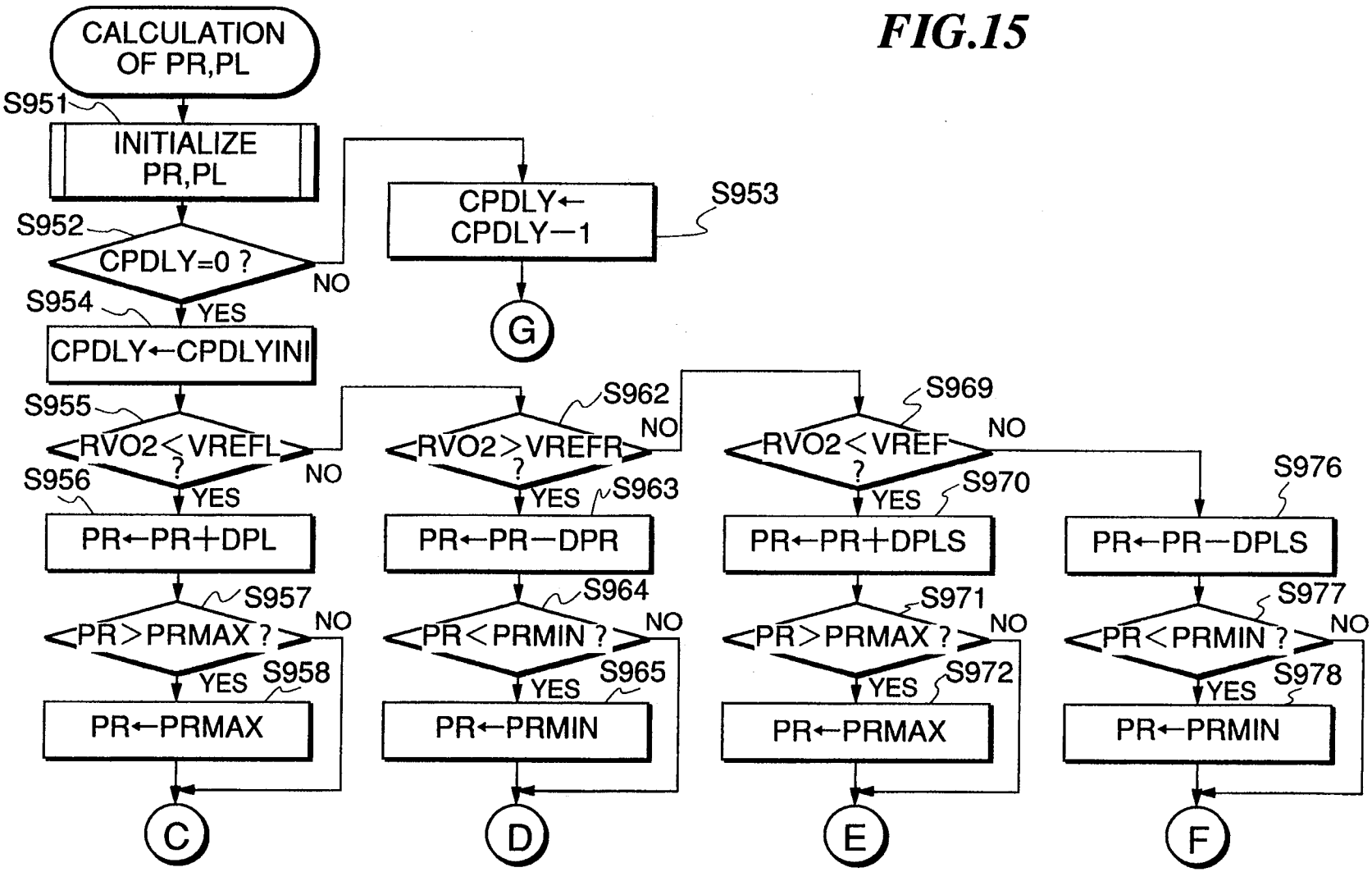
FIG. 15 is a flowchart showing a routine for calculating proportional terms PL and PR.
Figure 16:
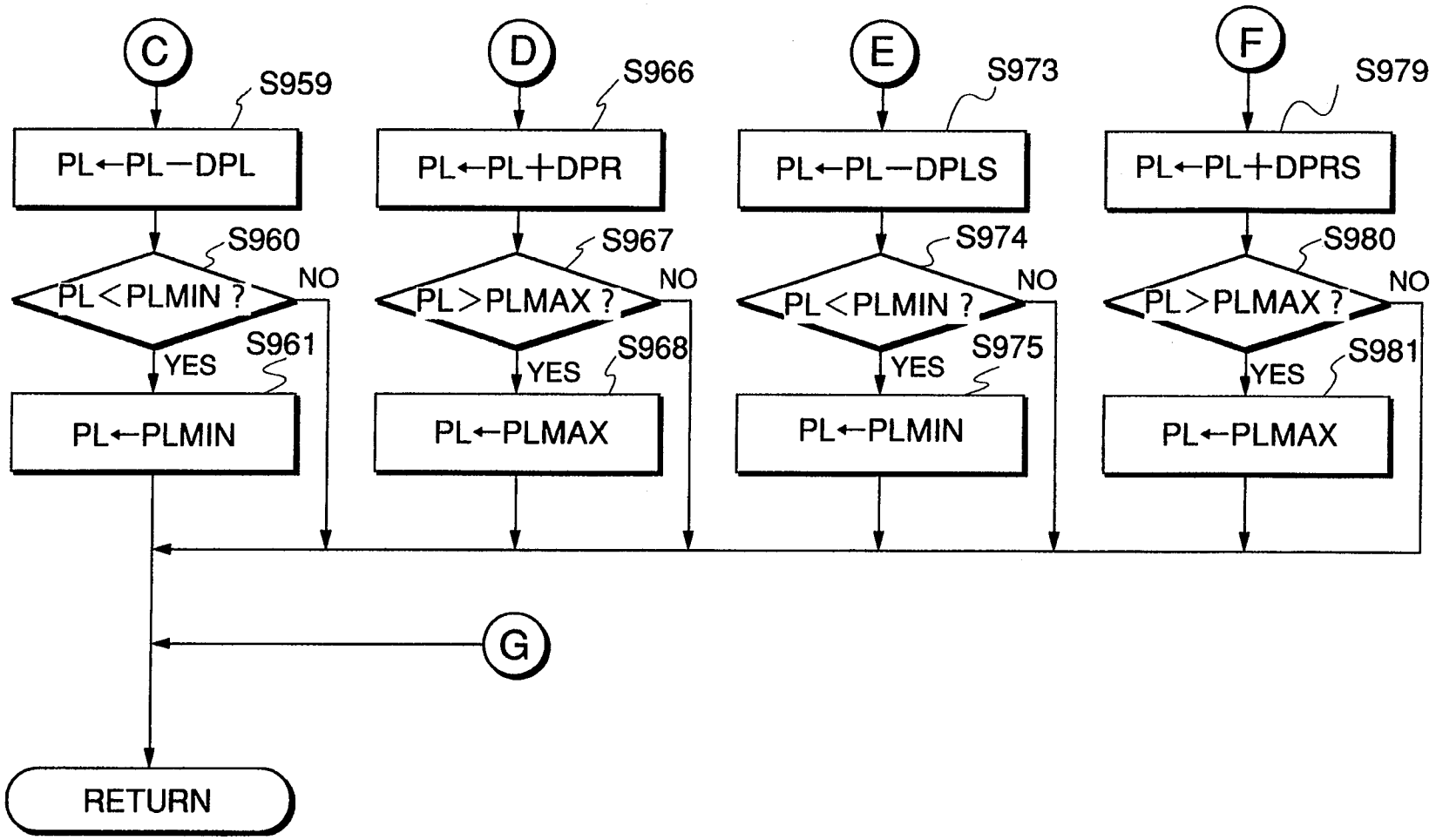
FIG. 16 is the remaining part of the FIG. 15 flowchart.

FIG. 15 and FIG. 16 show details of the subroutine executed at the step S859 of the FIG. 12 program for calculating the proportional terms PL, PR. Here, the proportional terms PL, PR are calculated according to variation in the output RVO2 from the downstream O2 sensor 14R.

First, at a step S951, the proportional terms PL and PR are initialized by a subroutine, referred to hereinafter, and then, it is determined at a step S952 whether or not a count value CPDLY1 of a counter CPDLY for measuring a delay time in calculating the proportional term is equal to "0". If the answer to this question is negative (NO), the program proceeds to a step S953, wherein the count value CPDLY is decreased by a decrement of 1, followed by terminating the program. On the other hand, if the answer to the question of the step S952 is affirmative (YES), the program proceeds to a step S954, wherein the count value CPDLY is reset to an initial value CPDLYINI thereof.

At the following step S955, it is determined whether or not the output RVO2 from the downstream O2 sensor 14R is lower than a reference value VREFL on the lean side. If the answer to this question is affirmative (YES) (RVO2<VREFL), the program proceeds to a step S956, wherein a value DPL is added to the immediately preceding value of the proportional term PR to set the resulting value to the present value thereof. Then, at a step S957, it is determined whether or not the proportional term PR is larger than an upper limit value PRMAX.

If the answer to this question is affirmative (YES), i.e. if PR>PRMAX, the upper limit value PRMAX is set to the proportional term PR at a step S958, followed by the program proceeding to a step S959. On the other hand, if the answer to the question of the step S957 is negative (NO), i.e. if PR≦PRMAX, the program skips over the step S958 to the step S959.

At the step S959, the predetermined value DPL is subtracted from the immediately preceding value of the proportional term PL to set the resulting value to the present value thereof, and then at a step S960, it is determined whether or not the present value of the proportional term PL is smaller than a lower limit value PLMIN. If the answer to this question is affirmative (YES), i.e. if PL<PLMIN, the lower limit value PLMIN is set to the proportional term PL at a step S961, followed by terminating the program. If the answer to the question of the step S960 is negative (NO), i.e. if PL≧PLMIN, the step S961 is skipped over, followed by terminating the program.

On the other hand, if the answer to the question of the step S955 is negative (NO) (RVO2≧VREFR), it is determined at a step S962 whether or not the output RVO2 is higher than a reference value VREFR on the rich side. If the answer to this question is affirmative (YES) (RVO2>VREFR), the program proceeds to a step S963, wherein a predetermined value DPR is subtracted from the immediately preceding value of the proportional term PR to set the resulting means to the present value thereof. Then, at a step S964, it is determined whether or not the resulting proportional term PR is smaller than a lower limit value PRMIN thereof.

If the answer to the question of the step S964 is affirmative (YES), i.e. if PR<PRMIN, the lower limit value PRMIN is set to the proportional term PR at a step S965, and the program proceeds to a step S966. On the other hand, if the answer to the question of the step S964 is negative (NO), i.e. if PR≧PRMIN, the program skips over the step S965 to the step S966.

At the step S966, the value DPR is added to the immediately preceding value of the proportional term PL to set the resulting value to the present value thereof. Then, it is determined at a step S967 whether or not the resulting proportional term PL is larger than an upper limit value PLMAX thereof. If the answer to this question is affirmative (YES), i.e. if PL>PLMAX, the upper limit value PLMAX is set to the proportional term PL, followed by terminating the program, whereas if the answer is negative (NO), i.e. if PL≦PLMAX, the step S968 is skipped over, followed by terminating the program.

On the other hand, if the answer to the question of the step S962 is negative (NO) (RVO2≦VREFR), it is determined at a step S969 whether or not the output RVO2 from the downstream O2 sensor 14R is lower than a reference value VREF therefor. If the answer to this question is affirmative (YES)(RVO2<VREF), the program proceeds to a step S970, where a predetermined value DPLS is added to the immediately preceding value of the proportional term PR to set the resulting value to the present value thereof. Further, at a step S971, it is determined whether or not the resulting proportional term PR is larger than the higher limit value PRMAX.

If the answer to the question of the step S971 is affirmative (YES), i.e. if PR>PRMAX, the upper limit value PRMAX is set to the proportional term PR at a step S972, and then the program proceeds to a step S973. On the other hand, if the answer to the question of the step S971 is negative (NO), i.e. if PR≦PRMAX, the program skips over the step S972 to the step S973.

At the step S973, the present value of the proportional term PL is calculated by subtracting a predetermined value DPLS from the immediately preceding value of the proportional term PL, and then it is determined at a step S974 whether or not the resulting proportional term PL is smaller than the lower limit value PLMIN. If the answer to this question is affirmative (YES), i.e. if PL<PLMIN, the lower limit value PLMIN is set to the proportional term PL at a step S975, followed by terminating the program. If the answer to the question of the step S974 is negative (NO), i.e. if PL≧PLMIN, the step S975 is skipped over, followed by terminating the program.

On the other hand, if the answer to the question of the step S969 is negative (NO) (RVO2≧VREFR), the program proceeds to a step S976, wherein a predetermined value DPRS is subtracted from the immediately preceding value of the proportional term PR to set the resulting value to the present value thereof. Further, at a step S977, it is determined whether or not the resulting proportional term PR is smaller than the lower limit value PRMIN. If the answer to this question is affirmative (YES), i.e. if PR<PRMIN, the lower limit value PRMIN is set to the proportional term PR at a step S978, and then the program proceeds to a step S979. If the answer to the question of the step S977 is negative (NO), i.e. if PR≧PRMIN, the program skips over the step S978 to the step S979.

At the step S979, the present value of the proportional term PL is calculated by adding the predetermined value DPRS to the immediately preceding value of the proportional term PL to set the resulting value to the present value thereof, and then it is determined at a step S980 whether or not the resulting proportional term PL is larger than the upper limit value PLMAX. If the answer to this question is affirmative (YES), i.e. if PL≦PLMAX, the upper limit value PLMAX is set to the proportional term PL at a step S981, followed by terminating the program. If the answer to the question of the step S980 is negative (NO), i.e. if PL≦PLMAX, the step S981 is skipped over, followed by terminating the program.

Thus, according to the present embodiment, if the condition of VREFL≦RVO2≦VREFR is satisfied, the increment and decrement of the proportional terms PR, PL are decreased, whereas if the output RVO2 from the downstream O2 sensor 14R falls outside the above range, the increment and decrement of same are increased, while setting the proportional terms PR and PL to the lower and the upper limit values. Thus, the proportional terms PR and PL are calculated based on the output RVO2 from the downstream O2 sensor 14R to prevent the air-fuel ratio from being disturbed due to an undesirable variation in characteristics of the upstream O2 sensor 14F.

Figure 17:
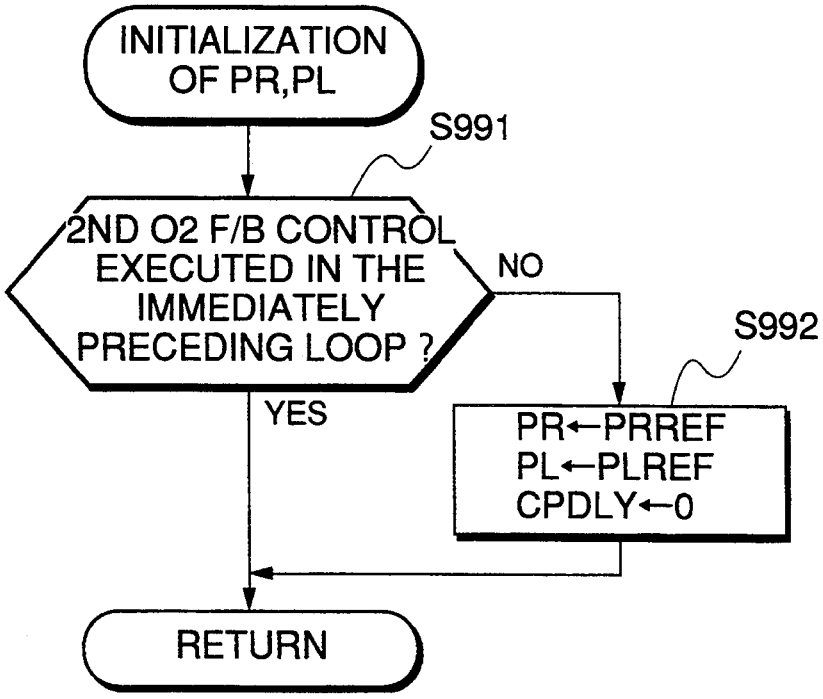
FIG. 17 is a flowchart showing a subroutine for executing initialization of the proportional terms PL, PR.

FIG. 17 shows a subroutine executed at the step S951 of the FIG. 15 program for initializing the proportional terms PR and PL.

First, at a step S991, it is determined whether or not the 2nd O2 F/B control was carried out in the immediately preceding loop. If the answer to this question is affirmative (YES), the program is immediately terminated, whereas if the answer is negative (NO), the program proceeds to a step S992, wherein the proportional terms PL and PR are set to the respective values PLREF and PRREF, and the count value CPDLY is set to a value of 0, followed by terminating the program. The values PLREF, PRREF are average values of the proportional terms PL, PR calculated in the program described hereinabove.

Figure 18:
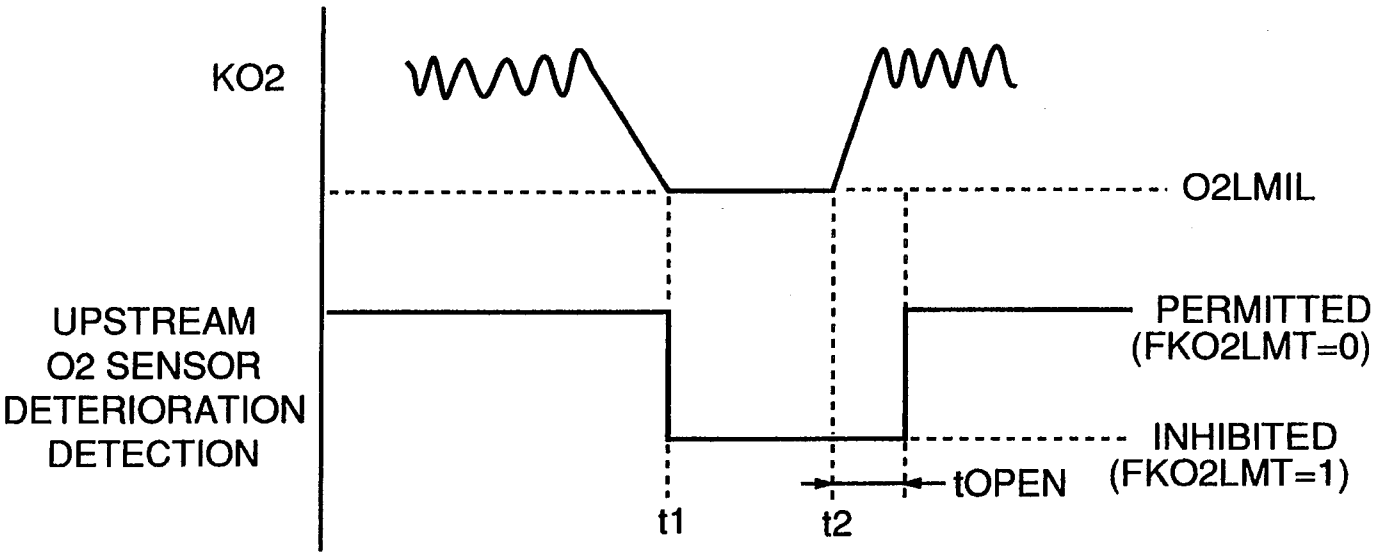
FIG. 18 is a timing chart useful in explaining the features of the invention.

FIG. 18 shows a timing chart useful in explaining the feature of the present embodiment. The figure shows an example where the KO2 value is held at the lower limit value KO2LMTL. Before the time point t1 the KO2 value is held at the lower limit value KO2LMTL, the flag FKO2LMT is set to "0", whereby the detection of deterioration of the upstream O2 sensor 14F is permitted. After the time point t1 and before the time point t2, due to purging of a large amount of evaporative fuel into the intake system, for instance, the KO2 value is held at the lower limit value KO2LMTL, so that the flag FKO2LMT is set to "1", whereby the detection of deterioration of the upstream O2 sensor 14F is inhibited. After the time point t2, the amount of evaporative fuel is decreased so that the KO2 value returns from the lower limit value KO2LMTL to an intermediate value within the predetermined range. However, the flag FKO2LMT continues to be set to "1" until the predetermined time period tOPEN elapses. Thus, the detection of deterioration of the upstream O2 sensor 14F is permitted after the air-fuel ratio control becomes stable.

A second embodiment of the invention will be described with reference to FIG. 19 which shows a program for carrying out limit check of the air-fuel ratio correction coefficient KO2. The second embodiment is different from the first embodiment described hereinabove only in the limit check of the KO2 value, and FIGS. 1 to 10 and 12 to 17 are applicable to the second embodiment as well. According to the second embodiment, two sets of upper and lower limit values KO2LMTH1, KO2LMTL1; KO2LMTH2, KO2LMTL2 are provided, with which the KO2 value is to be compared. The second upper and lower limit values KO2LMTH2, KO2LMTL2 correspond to the upper and lower limit values KO2LMTH, KO2LMTL employed in the first embodiment (FIG. 11), which are set at such values (e.g. 1.35 and 0.64, respectively) that if the KO2 value falls out of the range defined by the upper and lower limit values KO2LMTH2, KO2LMTL2, the air-fuel ratio cannot be properly controlled. The first upper and lower limit values KO2LMTH1, KO2LMTL1 according to the present embodiment are provided for deciding whether to inhibit the detection of deterioration of the upstream O2 sensor 14F and set at values (e.g. 1.30 and 0.70, respectively) slightly closer to the central or no-correction value of 1.0 than the second upper and lower limit values KO2LMTH2, KO2LMTL2.

Figure 19:
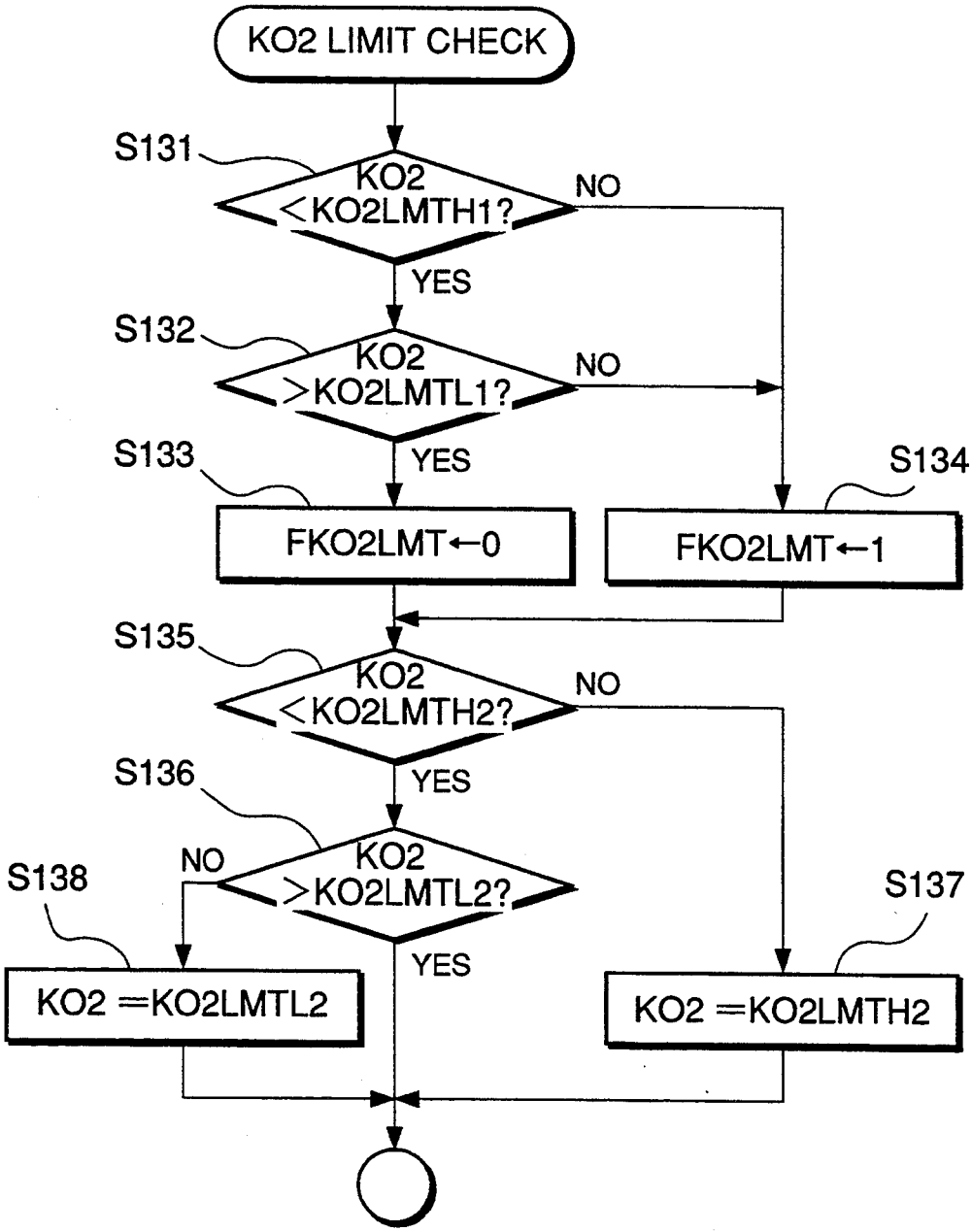
FIG. 19 is a flowchart for carrying out limit check of the correction coefficient KO2 according to a second embodiment of the invention.

In FIG. 19, it is determined at a step S131 whether or not the KO2 value is below the first upper limit value KO2LMTH1. If the answer is affirmative (YES), it is determined at a step S132 whether or not the KO2 value is above the first lower limit value KO2LMTL1. IF the answer is affirmative (YES), i.e. if the KO2 value falls within the range defined by the first upper and lower limit values KO2LMTH1, KO2LMTL1, the flag KO2LMT is set to "0" indicating permission of the detection of deterioration of the upstream O2 sensor 14F, at a step S133.

On the other hand, if the answer to either the step S131 or the step S132 is negative (NO), the flag FKO2LMT is set to "1" indicating inhibition of the detection of deterioration of the upstream O2 sensor 14F, at a step S134.

Then, at a step S135, it is determined whether or not the KO2 value is below the second upper limit value KO2LMTH2. If the answer is affirmative (YES), it is determined at a step S136 whether or not the KO2 value is above the second lower limit value KO2LMTL2. If the answer is affirmative (YES), i.e. if the KO2 value falls within the range defined by the second upper and lower limit values KO2LMTH2, KO2LMTL2, the present program is terminated, to use the KO2 value as it is. On the other hand, if the answer to the question of the step S135 is negative (NO), the KO2 value is set to the second upper limit value KO2LMTH2, whereas if the answer to the question of the step S136 is negative (NO), the KO2 value is set to the second lower limit value KO2LMTL2.

Figure 20:
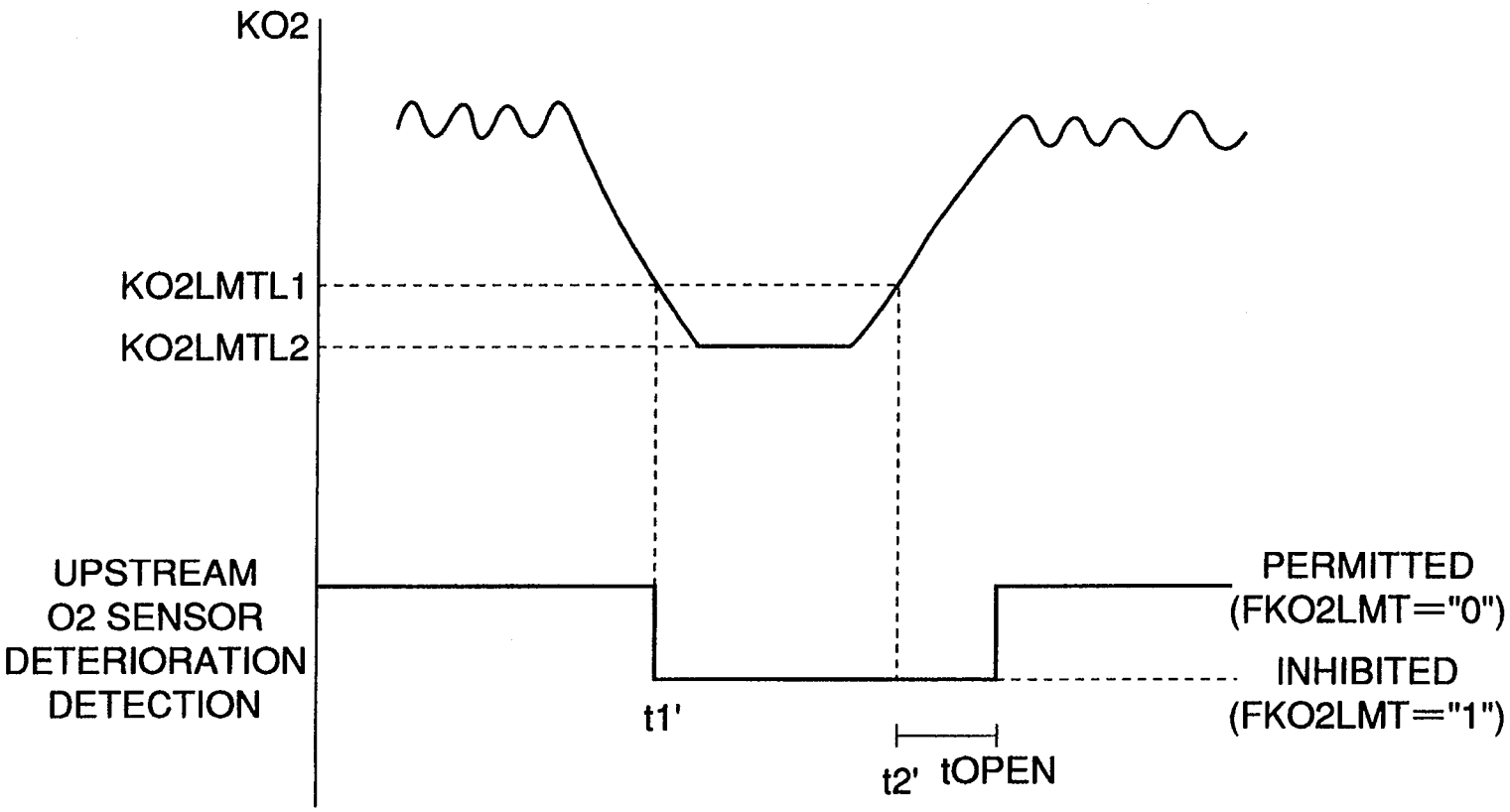
FIG. 20 is a timing chart useful in explaining the feature of the second embodiment.

FIG. 20 is a timing chart useful in explaining the feature of the second embodiment described above. According to the second embodiment, as distinguished from FIG. 18 showing the first embodiment, before a time point t1 the KO2 value reaches the first lower limit value KO2LMTL1, the flag FKO2LMT is set to "0", whereby the detection of deterioration of the upstream O2 sensor 14F is permitted. After the time point t1' and before a time point t2' where the air-fuel ratio is rich due to purging of a large amount of evaporative fuel into the intake pipe 2 or the like, the KO2 value is decreased below the first lower limit value KO2LMTL1 so that the flag FKO2LMT is set to "1", whereby the detection of deterioration of the upstream O2 sensor 14F is inhibited, even before the KO2 reaches the second lower limit value KO2LMTL2. Then, the KO2 value reaches and is temporarily held at the second lower limit value KO2LMTL2. When the amount of evaporative fuel decreases, for instance, the KO2 value is increased above the first lower limit value KO2LMTL1 at the time point t2'. Upon the lapse of the predetermined time period tOPEN after the time point t2', the flag FKO2LMT is set to "0" to permit the detection of deterioration of the upstream O2 sensor 14F.

Thus, according to the second embodiment, described above, the predetermined KO2 range for determination of deterioration of the upstream O2 sensor is set so as to be included within the normal KO2 limiting range, and therefore, the air-fuel ratio control can be more stably carried out. As a result, detection of deterioration of the upstream O2 sensor can be carried out with higher accuracy.

Although in the embodiments described above, deterioration of the upstream O2 sensor is detected based on the inversion period with which the output from the upstream O2 sensor is inverted, alternatively, it may be detected based on the air-fuel ratio correction amount (air-fuel ratio correction coefficient KO2) calculated at least in response to the output from the upstream O2 sensor, such as the inversion period of the air-fuel ratio correction amount.

What is claimed is:

1. An air-fuel ratio sensor deterioration-detecting device for an internal combustion engine having an exhaust system, catalytic converter means arranged in said exhaust system, first and second air-fuel ratio sensor means arranged in said exhaust system upstream and downstream of said catalytic converter means, respectively, air-fuel ratio correction amount-calculating means for calculating an air-fuel ratio correction amount, based on outputs from said first and second air-fuel ratio sensor means, and air-fuel ratio control means for controlling an air-fuel ratio of a mixture supplied to the engine, based on the calculated air-fuel ratio correction amount, comprising:

deterioration-detecting means for detecting deterioration of said first air-fuel ratio sensor means, based on the output from said first air-fuel ratio sensor means; and deterioration detection-inhibiting means for inhibiting operation of said deterioration-detecting means when said air-fuel ratio correction amount falls outside a predetermined range.

2. An air-fuel ratio sensor deterioration-detecting device as claimed in claim 1, including deterioration detection-permitting means for permitting the operation of said deterioration-detecting means after a predetermined time period elapses after said air-fuel ratio correction amount returns into said predetermined range.

3. An air-fuel ratio sensor deterioration-detecting device as claimed in claim 1, including limiting means for limiting said air-fuel ratio correction amount within a first predetermined range when said air-fuel ratio correction amount falls outside said first predeatermiend range, and wherein said deterioration detection-inhibiting means inhibits the operation of said deterioration-detecting means when said air-fuel ratio correction amount falls outside a second predetermined range included within said first predetermined range.

4. An air-fuel ratio sensor deterioration-detecting device as claimed in claim 1, including inversion period-measuring means for measuring an inversion period with which the output from said first air-fuel ratio sensor means is inverted, and wherein said deterioration-detecting means detects deterioration of said first air-fuel ratio sensor means, based on the measured inversion period.

* * * * *